US005737681A

United States Patent [19]

Hyakutake et al.

[11] Patent Number: 5,737,681

[45] Date of Patent: Apr. 7, 1998

[54] IMAGE FORMING APPARATUS HAVING CURLING DEVICE FOR HOLDING TRANSFER MATERIAL AND METHOD OF CURLING SHEET

[75] Inventors: Nobuo Hyakutake; Yasuo Nakamura; Fumio Furusawa; Keiji Yamamoto; Masaaki Tokunaga; Satoshi Fukada; Satoru Torimaru; Yoshihiro Enomoto; Tetsuya Fujita; Nobuyoshi Komatsu, all of Ebina, Japan

[73] Assignee: Fuji Xerox Co., Ltd., Tokyo, Japan

[21] Appl. No.: 603,159

[22] Filed: Feb. 20, 1996

[30] Foreign Application Priority Data

Feb. 22, 1995 [JP] Japan ..... 7-033461
Oct. 19, 1995 [JP] Japan ..... 7-270857

[51] Int. Cl.[6] ..... G03G 15/00

[52] U.S. Cl. ..... 399/388; 399/389; 399/390

[58] Field of Search ..... 399/388, 389, 399/390, 406; 162/270, 271; 271/188, 209

[56] References Cited

U.S. PATENT DOCUMENTS 4,475,896 10/1984 Bains ..... 493/454
5,113,226 5/1992 Tadokoro et al. ..... 399/390
5,442,429 8/1995 Bartholmae et al. ..... 399/406
5,565,970 10/1996 Suda ..... 399/406
5,602,636 2/1997 Matsuzawa ..... 399/388

FOREIGN PATENT DOCUMENTS 56-46274 4/1981 Japan .
3-73750 3/1991 Japan .
5-27608 2/1993 Japan .

*Primary Examiner*—William J. Royer
*Attorney, Agent, or Firm*—Oliff & Berridge, P.L.C.

[57] ABSTRACT

A developing device which develops an electrostatic latent image formed on an image carrier by toner, thereby forming a toner image; a transferring device which transfers the toner image to a fed transfer material; a registration device which provides a timing of feeding the transfer material; a curling device which nips the transfer material so as to produce a curl which is curved in the same direction as the transferring device; a curling control device which controls a nip operation mechanism of the curling device; and mode setting means for instructing the curling control device to operate are disclosed. In accordance with a thick sheet mode set in the mode setting means, the nip operation of the curling device is executed and a dummy transfer period in which the transfer operation of the transferring device is stopped is set.

17 Claims, 18 Drawing Sheets

IMAGE FORMING APPARATUS HAVING CURLING DEVICE FOR HOLDING TRANSFER MATERIAL AND METHOD OF CURLING SHEET

BACKGROUND OF THE INVENTION

The present invention relates to an image forming apparatus, and particularly to an image forming apparatus which comprises a curling device for correctly holding a transfer material to a transfer portion between an image carrier and a transferring device for transferring a toner image formed on the image carrier.

In an image forming apparatus such as an electrophotographic copier or a printer, an electrostatic latent image which is formed on the surface of an image carrier such as a photosensitive drum and corresponds to an image signal is developed by toner, and the toner image is transferred to a transfer material such as a copy sheet and then fixed, thereby forming a so-called copy.

In the transfer of a toner image, the transfer material must be fed at a correct timing to a transfer portion between the image carrier and a transferring device which is disposed with opposingly contacting with the image carrier.

Generally, the timing of feeding a transfer material is provided to the transfer material fed from a transfer material housing tray, by a registration roll which is disposed immediately before the transfer portion.

The registration roll has a function of feeding a transfer material at predetermined timing when a toner image formed on the image carrier is caused to reach the transfer portion by the rotation of the image carrier.

In the transfer of a multicolor image using a transfer drum, particularly, a first color toner image is transferred to a transfer material fed to the transfer portion, the transfer material is then revolved while being attracted and held by the transfer drum, a second color toner image is transferred in the transfer portion so as to overlap the first color toner image on the same transfer material, and third and fourth color toner images are similarly caused to overlap, thereby obtaining a multicolor image. When the transfer material reaches the transfer portion at an incorrect timing, the color toner images are positionally shifted from each other, with the result that an image of reduced quality in which color images are misaligned is obtained.

When a thin transfer material is used, the problem of positional misalignment of colors is not particularly issued. In contrast, when a thick transfer material is used, the transfer material is hardly attracted and held by the surface of the transfer drum and the front end of the transfer material is hardly bent, and hence the timing of entering the transfer portion may be delayed or a jam may occur in the transfer portion. This may cause the color misalignment to occur or the apparatus to be stopped.

In order to solve the problems, a countermeasure has been taken in which a curling device is disposed as auxiliary attracting means for producing a curl curved in the same direction as the transfer drum in the transfer material, so that the transfer material smoothly enters the transfer portion and is then attracted and held by the transfer drum.

In addition to the case where a thick transfer material is used, also in the double-side copy mode, the timing of entering the transfer portion may be shifted or a jam may occur because, when a curl produced in the copy cycle for the first side remains, the curvature of the curl of the transfer material which is taken out from a double-side copy tray and in the transfer portion of the copy cycle for the second side is opposite in direction to that of the transfer drum. To comply with this, in a known configuration, a curling device similar to that described above produces a curl which is curved in the same direction as the transfer drum, in a transfer material.

An image forming apparatus comprising such a curling device is disclosed in, for example, Japanese Patent Publication (Kokai) No. HEI 5-27,608. A prior art technique such as that in which a curling operation is applied on a transfer material entering a transfer portion so as to facilitate the separation of the transfer material from a photosensitive member is disclosed in, for example, Japanese Patent Publications (Kokai) Nos. SHO 56-46,274 and HEI 3-73,750.

In the prior art techniques, image formation positions of a multicolor image are shifted from each other to cause the color misalignment because of the following reason, and the like: in the process of producing a curl in a transfer material by the curling device which serves as auxiliary attracting means when a thick transfer material is to be attracted and held by the transfer drum, the load of a transporting mechanism is changed depending on the thickness of the transfer material; the position (tacking position) where the front end of the transfer material contacts with the transfer drum is varied; and, depending on whether the curling device is activated or not, the rotational speed of the transfer drum and the speed of feeding the transfer material are differentiated from each other.

When the image forming mechanism is driven by one motor in order to simplify the structure of the image forming apparatus, particularly, the load of the motor is varied depending on whether the curling device is activated or not, thereby producing a problem in that the color misalignment is caused similarly.

In the prior art, when a special transfer material such as an envelope is used, it is impossible to produce a curl which conforms to the quality and shape of the transfer material.

In the curling device of the prior art in which the hard roll and the elastic roll are combinedly used, the rolls are rotated while contacting with each other in a strongly pressed manner, thereby producing a curl in a transfer material. Therefore, there arises another problem in that the elastic roll is deformed so that a desired curl cannot be formed.

SUMMARY OF THE INVENTION

It is an object of the present invention to provide an image forming apparatus which can solve the problems of the prior art, and in which, particularly in the cases where a multicolor image is formed by using a thick transfer material, where a double-side copy is obtained by using a usual transfer material, and where a special transfer material such as an envelope is used, image formation positions are prevented from being shifted from each other so that an image of high quality can be obtained.

In order to attain the object, the invention of is characterized in that the apparatus comprises: an image carrier; a developing device which develops an electrostatic latent image formed on the surface of the image carrier by toner, thereby forming a toner image; a transferring device which is disposed with opposingly contacting with the image carrier, which electrostatically attracts and transports a transfer material fed between the image carrier and the transferring device, and which transfers the toner image carried on the image carrier to the transfer material; a registration device which provides a timing of feeding the transfer material which is to be fed to a portion where the image carrier opposingly contacts with the transferring device; a curling device which is disposed upstream of the portion where the image carrier opposingly contacts with the transferring device, in a direction of transporting the transfer material, and which produces a curl in the transfer material, the curl being curved in the same direction as the transferring device; and a control device which, during a period when the curling device is activated, inhibits an image forming operation, and which, after the curling device is activated, starts the image forming operation.

The second invention is characterized in that the curling device is activated on the basis of the setting of a mode setting means for setting a mode in which the transfer material is a thick sheet.

The third invention is characterized in that the curling device is activated on the basis of the setting of a mode setting means for instructing that the transfer material is an envelope.

The fourth invention is characterized in that the curling device is activated on the basis of the setting of a mode setting means for instructing that a copy mode is set to double-side copy, and before a transfer is conducted on a second side of the transfer material.

The fifth invention is characterized in that the curling device is operated so that, with respect to the second side of the transfer material, a curling operation is applied only on a region which is separated from the front end of the transfer material by a distance ($L_0$) which is shorter than a distance (L) between the curling device and the opposingly contacting portion.

The sixth invention is characterized in that existence of an image on the back side of the transfer material fed to the registration device is detected, and the curling device is activated in response to a signal indicative of existence of an image.

The seventh invention is characterized in that the apparatus further comprises manual sheet feed mode setting means for instructing that the transfer material is fed from a manual sheet feed tray, and the curling device is activated on the basis of the setting of the manual sheet feed mode setting means.

The eighth invention is characterized in that the apparatus further comprises a mode setting means for instructing that the transfer material is at least a thick sheet, and, when a manual sheet feed mode is set in the manual sheet feed mode setting means and a thick sheet mode is not set in the mode setting means, the curling device is operated by the curling control device so that a curling operation is applied only on a region which is separated from the front end of the transfer material by a distance ($L_0$) which is shorter than a distance (L) between the curling device and the portion where the image carrier opposingly contacts with the transferring device.

The ninth invention is characterized in that transparentness/opaqueness of the transfer material fed to the registration device is detected, and, when transparentness of the transfer material is detected, the curling device is inhibited from operating.

The tenth invention is characterized in that, when a manual sheet feed mode is set in the manual sheet feed mode setting means and transparentness of the transfer material fed from the manual sheet feed tray is detected, the curling device is inhibited from operating, and, when opaqueness of the transfer material fed from the manual sheet feed tray is detected, the curling device is operated so that a curling operation is applied only on a region which is separated from the front end of the transfer material by a distance ($L_0$) which is shorter than a distance (L) between the curling device and the opposingly contacting portion.

The eleventh invention is characterized in that the curling device comprises an elastic roll of a larger diameter, a hard roll of a smaller diameter, and a nip operation mechanism for the rolls, and, when the power for the image forming apparatus is shut down, a nip operation of the larger elastic roll and the smaller hard roll is canceled.

In the inventions described above, the image carrier includes a photosensitive drum or a photosensitive belt. The inventions may be applied also to an image forming apparatus in which a toner image formed on such a photosensitive member is once transferred to an intermediate transfer member and then transferred to a transfer material.

The transferring device includes not only a transfer drum but also a transfer belt. As the transfer material, so-called plain paper, an envelope-like material, a thick sheet or an OHP sheet may be used.

In the present invention, the apparatus may be controlled so that, in double-side copy wherein a thick sheet is used as the transfer material, a curling operation is applied on the whole region of the sheet from the front end to the rear end, in the copy cycle for the second side. In this case, the thick sheet mode and the double-side copy mode are set by the mode setting means, whereby a combination of the second and fourth inventions is executed.

It is a matter of course that the present invention can be applied to both monocolor copy and multicolor copy.

In the configurations of the first to fifth inventions, the image carrier has a photosensitive surface, and static electricity is uniformly applied to the surface. Thereafter, an electrostatic latent image is formed by using a light beam such as a laser beam which is modulated by an image signal. The developing device develops the electrostatic latent image formed on the surface of the image carrier by using toner, thereby forming a toner image. The transferring device is disposed so as to opposingly contact with the image carrier, attracts and transports the transfer material fed between the transferring device and the image carrier, and transfers the toner image carried on the image carrier to the transfer material. The registration device is disposed upstream of the portion where the image carrier opposingly contacts with the transferring device, and provides a timing of feeding the transfer material which is to be fed to the transfer portion. The curling device is disposed between the registration device and the portion where the image carrier opposingly contacts with the transferring device, and nips the transfer material, thereby producing a curl which is curved in the same direction as the transferring device, in the transfer material. When the mode setting means is selected so as to set the thick sheet mode, the control device activates the nip operation mechanism of the curling device, and a curling control device which controls the nip and nonnip operations of the nip operation mechanism, thereby causing the nip operation mechanism of the curling device to execute the nip operation of the nip operation mechanism on the whole length of the transfer material which is a thick sheet, and causes a main control system MCS to execute a dummy transfer cycle in which the image formation is stopped during a period when the nip operation is conducted and the transfer material passes through the curling device, and only the transferring device is activated to attract and transport the transfer material (the transfer drum makes one rotation while attracting the transfer material).

When the mode setting means is selected so as to set an envelope mode, the control device activates the nip operation mechanism of the curling device, and the curling control device which controls the nip and nonnip operations of the nip operation mechanism, thereby causing the nip operation mechanism of the curling device to execute the nip operation of the nip operation mechanism only on the front end of the transfer material which is an envelope, and causes the main control system MCS to execute the dummy transfer cycle in which the image formation is stopped during a period when the nip operation is conducted and the transfer material passes through the curling device, and only the transferring device is activated to attract and transport the transfer material.

When the image forming apparatus is set to the double-side copy mode, a double-side copy tray once houses a transfer material in which the first-side copy cycle has been completed, and, in the second-side copy cycle, feeds the second side to the transfer portion. When the mode setting means is selected so as to set the double-side copy mode, the curling control device controls the nip operation mechanism of the curling device so as to apply a curling operation only on a region which is separated from the front end of the transfer material in which the second side is to be subjected to the transfer operation, by a distance ($L_0$) which is shorter than a distance (L) between the curling device and the portion where the image carrier opposingly contacts with the transferring device.

In the configuration of the sixth invention, a back-side sensor which is disposed upstream of the registration device outputs a detection signal indicative of existence of an image on the back side of the transfer material, thereby causing the transfer of the second side of the transfer material to be recognized. In accordance with the output, the curling control device controls the nip operation mechanism of the curling device so as to apply a curling operation only on a region which is separated from the front end of the transfer material in which the second side is to be subjected to the transfer operation, by a distance ($L_0$) which is shorter than a distance (L) between the curling device and the portion where the image carrier opposingly contacts with the transferring device.

In the configuration of the seventh invention, when the manual sheet feed mode setting means of the image forming apparatus is selected or a manual feed detector operates so as to instruct that the transfer material is to be fed from the manual sheet feed tray, the control device activates the nip operation mechanism of the curling device, and the curling control device which controls the nip and nonnip operations of the nip operation mechanism, thereby causing the nip operation mechanism of the curling device to execute the nip operation of the nip operation mechanism, and causes the main control system MCS to execute the dummy transfer cycle in which the image formation is stopped during a period when the nip operation is conducted and the transfer material passes through the curling device, and only the transferring device is activated to attract and transport the transfer material.

In the configuration of the eighth invention, when the manual sheet feed mode setting means is selected so as to instruct that the transfer material is to be fed from the manual sheet feed tray, if the thick sheet mode is not set in the mode setting means, the curling control device conducts a control so that a curling operation is applied only on a region in the range of a distance ($L_0$) which is shorter than a distance (L) between the curling device and the portion where the image carrier opposingly contacts with the transferring device.

In the configurations of the ninth and tenth inventions, when a transparentness/opaqueness sensor which is disposed in order to detect the transfer material fed to the registration device detects that the transfer material is transparent (e.g., an OHP sheet), the curling device is inhibited from operating, and, when the sensor detects that the transfer material is opaque, the curling control device controls the nip operation mechanism of the curling device so as to apply a curling operation only on a region which is separated from the front end of the transfer material by a distance ($L_0$) which is shorter than a distance (L) between the curling device and the portion where the image carrier opposingly contacts with the transferring device.

In the configuration of the eleventh invention, the curling device comprises the elastic roll of a larger diameter and the hard roll of a smaller diameter which produces a curl curved in the same direction as the transferring device in the transfer material, and the nip operation mechanism for the rolls, and, when the power for the image forming apparatus is shut down during the nip operation, the nip operation is canceled.

The inventions described above can be similarly executed also in manual double-side copy in which, in the double-side copy mode, the copy operation is done on the second side by using a manual sheet feeding device (multi-sheet inserter). The multi-sheet inserter has a function of automatically feeding a plurality of transfer materials placed on the manual sheet feed tray.

DETAILED DESCRIPTION OF THE PREFERRED EMBODIMENTS

Hereinafter, embodiments of the invention will be described in detail with reference to the drawings.

Figure 1A:
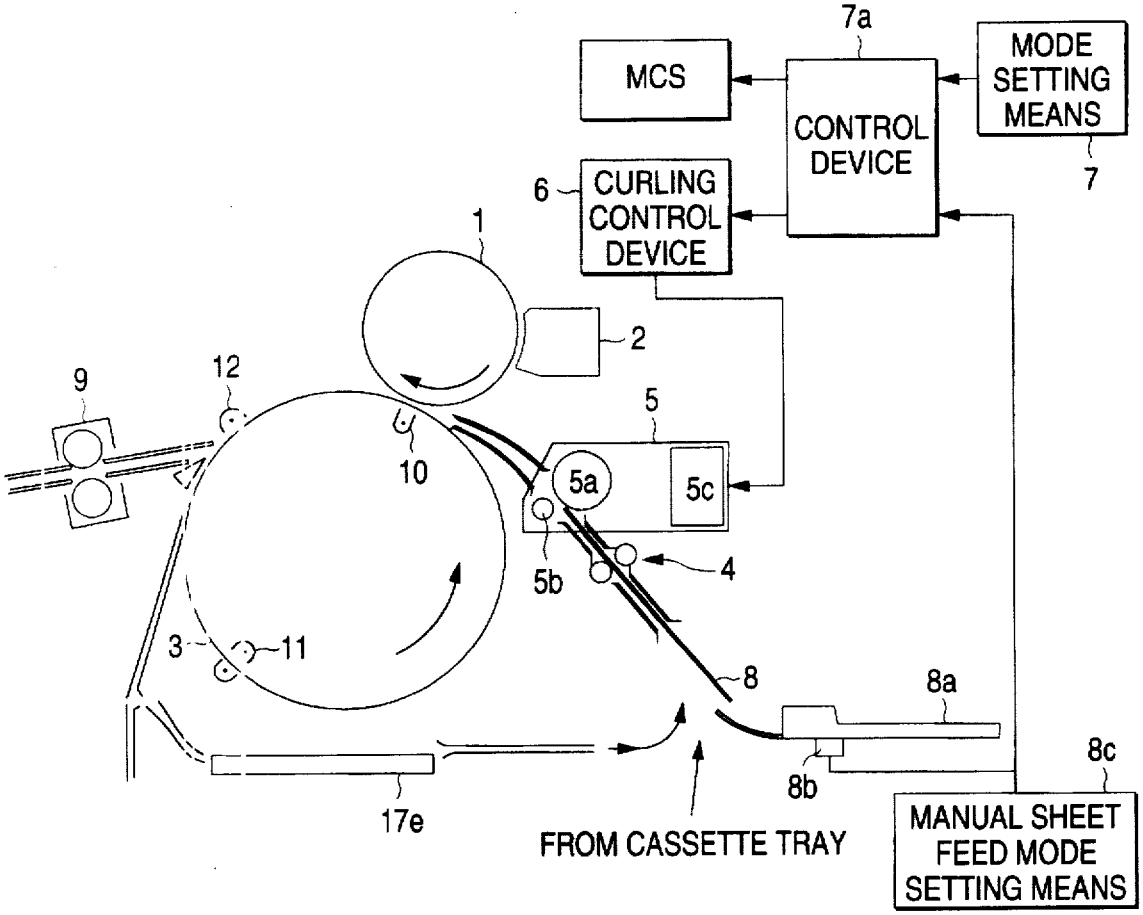
FIGS. 1A and 1B are diagrams illustrating the main portions of a first embodiment of the control system of the image forming apparatus of the invention.
Figure 1B:
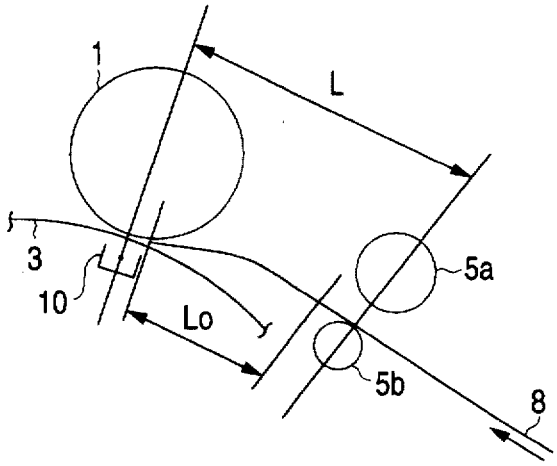

FIGS. 1A and 1B are diagrams illustrating a first example of the main configuration of the image forming apparatus of the invention. FIG. 1A is a diagram showing the configuration of the whole of the apparatus, and FIG. 1B is a diagram illustrating the curling process.

The reference numeral 1 designates a photosensitive drum serving as the image carrier, 2 designates a developing device, 3 designates a transfer drum serving as the transferring device, 4 designates a registration roll serving as the registration device, 5 designates a curling device, 5*a* designates an elastic roll, 5*b* designates a hard roll, 5*c* designates a nip operation mechanism, 6 designates a curling control device, 7 designates mode setting means, 7*a* designates a control device which, in accordance with instructions from the mode setting means, etc., controls a main control system MCS of the image forming apparatus so as to execute predetermined operations, 8 designates a transfer material, 8*a* designates a manual sheet feed tray, 8*b* designates a manual feed detector, 8*c* designates manual sheet feed mode setting means, 9 designates a fixing device, 10 designates a transfer corotron, 11 designates a discharge corotron, 12 designates a separation corotron, and 17*e* designates a double-side copy tray.

In FIG. 1A, static electricity is uniformly applied to the surface of the photosensitive drum 1 by a charging device which is not shown, and then an electrostatic latent image is formed by using a light beam such as a laser beam which is modulated by an image signal. The light beam is subjected to the main scanning by an optical scanning system having a polygon mirror, etc., and to a subscanning by the rotation of the photosensitive drum.

When the photosensitive drum 1 is rotated to the position of the developing device 2, the developing device 2 develops the electrostatic latent image formed on the surface of the photosensitive drum 1 by using toner, thereby forming a toner image.

When the photosensitive drum 1 is further rotated, the drum reaches the transfer portion where it opposingly contacts with the transfer drum 3. The transfer drum 3 opposingly contacts with the photosensitive drum 3 and transfers the toner image carried on the photosensitive drum 1 to the transfer material 8 fed between the transfer drum and the photosensitive drum 1.

On the other hand, the registration roll 4 which provides a timing of feeding the transfer material 8 transported from a cassette tray (not shown) to the transfer portion is disposed upstream of the transfer portion. The registration roll nips the front end of the transfer material 8 transported from the cassette tray so that the transfer material is once stopped, and then feeds the transfer material 8 to the transfer portion at a predetermined timing when the toner image on the photosensitive drum 1 reaches the transfer portion.

The curling device 5 which is disposed between the transfer portion and the registration roll 4 consists of the larger elastic roll 5*a*, the smaller hard roll 5*b*, and the nip operation mechanism 5*c* which conducts a nip operation of producing a curl in the transfer material 8 passing between the elastic roll 5*a* and the hard roll 5*b* and an operation of canceling the nip operation.

The curling device 5 is controlled by the curling control device 6. In accordance with the double-side mode, the thick sheet mode, or the envelope mode which is set in the mode setting means 7, the curling control device 6 controls the curling device 5 so as to conduct the nip operation on the whole of the transfer material from the front end to the rear end, or the front end of the material. In the embodiment, a transfer material of a thickness of about 105 to 157 gsm is called a thick sheet.

As a result of nipping the transfer material 8 by the nip operation, a curl which is curved in the same direction as the transfer drum 3 is produced in the transfer material 8, and a dummy transfer period when, during the nip operation, the image formation is stopped and only the transfer drum 3 is rotated in the state where the transfer material remains to be attracted to the transfer drum 3 is set.

FIG. 1B is a fragmentary view of FIG. 1A and particularly illustrating the curling process of a second-side copy which is conducted in the double-side copy mode. In the figure, L designates the distance between the curling device 5 and the portion (transfer portion) where the image carrier 1 opposingly contacts with the transferring device 3, and $L_0$ designates the region of the transfer material 8 fed for double-side copy where the curl is produced (i.e., the distance between the front end of the transfer material and the portion where the curl is terminated).

When a thin transfer material is used, in the copy of the first side, the copy cycle is executed while the curling process is conducted on the whole of the transfer material from the front end to the rear end, or the curling process is not conducted. With respect to a thick transfer material, preferably, a curling operation is applied on the whole of the material.

By contrast, in the case of double-side copy using a thin transfer material (in the embodiment, a usual transfer material of a thickness of 60 to 104 gsm is called a thin sheet), in the double-side copy mode, the transfer material remains to have deformation (waviness) after the first side is subjected to the copy operation. In the process of conducting the copy operation on the second side of the transfer material having waviness, when a curling operation is applied on the whole face (the whole region from the front end to the rear end) of the material, the transfer material is easily wrinkled or the curling device often causes the transfer material to be obliquely fed (skewed).

In order to prevent such phenomena from being produced, a configuration is formed in which, in the case where a curling operation is applied on the transfer material in which the second side is to be subjected to the copy operation, the nip operation of the curling device is made inoperative when the second side of the transfer material reaches the transfer portion, i.e., the transfer portion where the transfer corotron 10 is disposed and the image carrier 1 opposingly contacts with the transferring device 3.

Specifically, the elastic roll 5a and the hard roll 5b of the curling device 5 conduct the nip operation on the transfer material 8 with starting from its front end so as to start a curling operation. Before the transfer material reaches the transfer portion, the elastic roll 5a is retracted to cancel the nip operation, so that the curling region $L_0$ is shorter than the distance L between the curling device 5 and the portion (transfer portion) where the image carrier 1 opposingly contacts with the transferring device 3 ($L>L_0$), whereby the curling operation is done only in the front end portion of the transfer material.

According to this configuration, it is possible to prevent the above-mentioned wrinkle of the transfer material 8 and the oblique feed (skew) which may be caused by the curling device from occurring. In the embodiment, it was appropriate to set the distance $L_0$ to be 50 mm.

Figure 2:
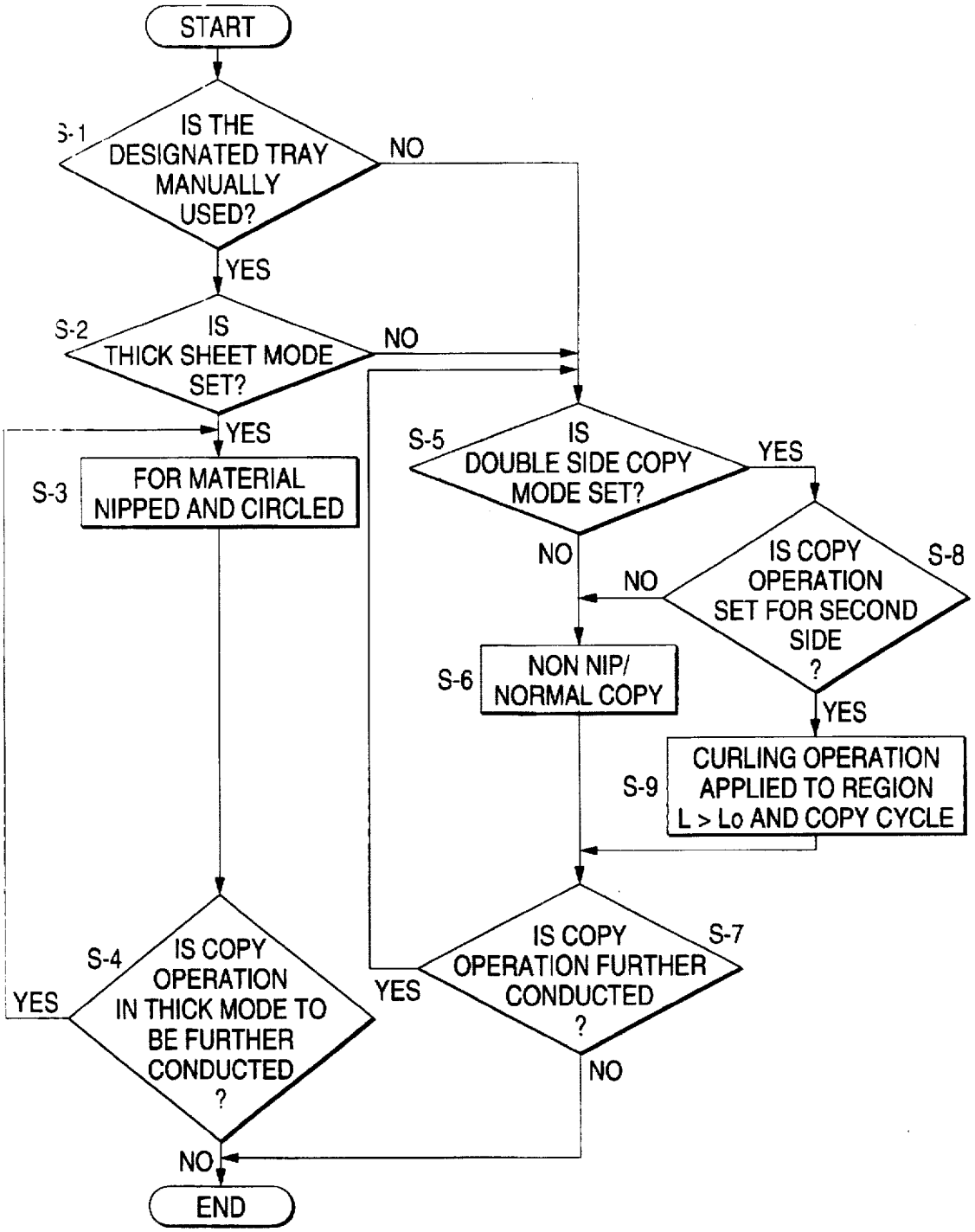
FIG. 2 is a flowchart illustrating the operation of the embodiment of the invention.

FIG. 2 is a flowchart illustrating the first embodiment of the image forming apparatus of the invention.

When the apparatus starts to operate, it is judged whether the designated tray is manually used (the manual sheet feed mode) or not (S-1). If the manual sheet feed mode is set, it is further judged whether the thick sheet mode is set or not (S-2). If the thick sheet mode is set, the curling device is activated so as to execute the nip operation/thick sheet copy cycle in which the transfer material is nipped and a curl is produced (S-3).

If the copy operation in the thick sheet mode is to be further conducted (S-4), the process returns to step S-3 so as to similarly execute the thick sheet copy cycle. If the copy operation is not required to be further conducted, the copy operation is terminated.

If the manual sheet feed mode is not set in step S-1 or the thick sheet mode is not set in step S-2, it is judged whether the double-side copy mode is set for the copy operation on the transfer material which is manually fed or not (S-5). If it is judged that the double-side copy mode is not set or the normal copy mode is set, the nonnip operation/normal copy cycle is executed (S-6). It is judged whether the copy operation is to be further conducted or not (S-7). If the copy operation is to be further conducted, the process returns to step S-6 so as to execute a similar copy cycle. If the copy operation is not required to be further conducted, the copy operation is terminated.

In contrast, if it is judged in step S-5 that the double-side copy mode is set, it is judged whether the copy operation is for the second side or not (S-8). If the copy operation is not for the second side or the first side is to be subjected to the copy operation, the process proceeds to step S-6 in which the nonnip operation/normal copy cycle is executed.

If it is judged in step S-8 that the copy operation is for the second side, the curling device is activated to conduct the curling operation so as to realize the above-mentioned relationship ($L>L_0$), and the normal copy cycle is executed (S-9).

In step S-6, a curling operation may be applied on the whole of the transfer material or a part of the front end.

In this way, the curling process can be conducted in an adequate manner in accordance with the kind of the transfer material in the manual sheet feed mode, or the copy mode, whereby a jam and deformation of the transfer material are prevented from occurring, with the result that a copy of high quality can be obtained.

Figure 3A:
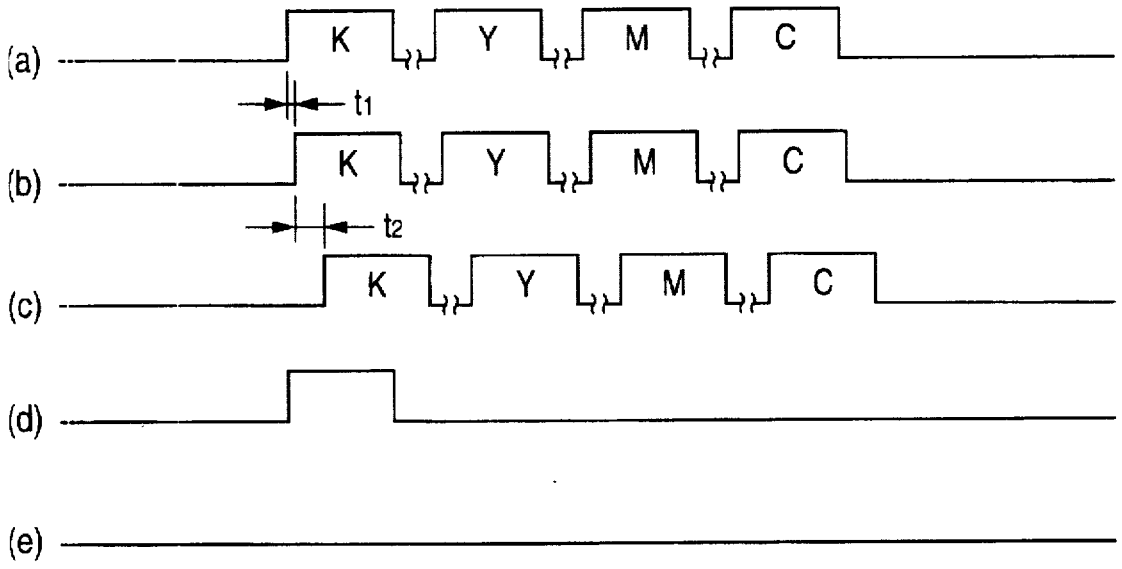
FIGS. 3A and 3B are timing charts illustrating the operation of the first embodiment of the invention.
Figure 3B:
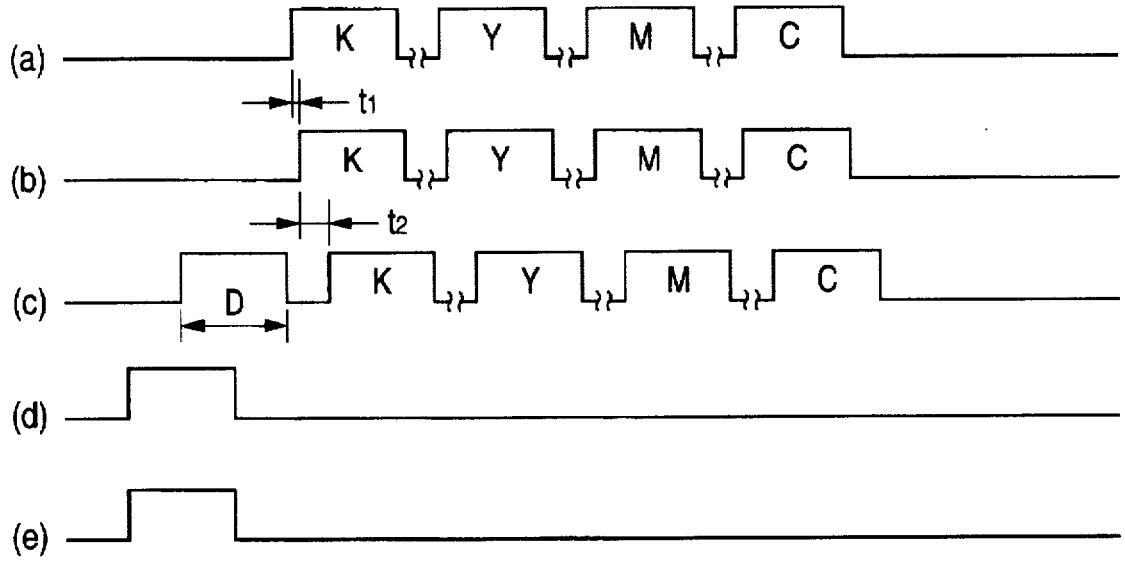

FIGS. 3A and 3B are timing charts illustrating the operation of the first embodiment of the invention. In the figures, (a) indicates the timing of writing an electrostatic latent image onto the photosensitive drum 1, (b) indicates the timing of developing the electrostatic latent image by toner, (c) indicates the timing of transferring the toner image, (d) indicates the operation timing of the registration roll 4, and (e) indicates the operation timing of the curling device 5.

Hereinafter, the operation of the configuration of FIG. 1A will be described with reference to the timing charts of FIGS. 3A and 3B. FIG. 3A shows the case where a usual transfer material (a usual transfer sheet) is used (no mode is set in the mode setting means). First, the photosensitive drum 1 which is uniformly charged at a predetermined polarity by the charging device is scanned by a laser beam which is modulated by an image signal in an image writing device (not shown) (a), thereby forming an electrostatic latent image. The operation of writing the electrostatic latent image is executed in the sequence of black (K) (first color), yellow (Y) (second color), magenta (M) (third color), and cyan (C) (fourth color).

When the photosensitive drum 1 is rotated to reach the position of the developing device 2 after an elapse of time $t_1$, an electrostatic latent image of the first color K is developed to become a K-color toner image (b). When the photosensitive drum 1 is further rotated to reach the transfer portion after an elapse of time $t_2$, the K-color toner image is transferred to the transfer material 8 fed between the photosensitive drum and the transfer drum 3 (c). At this time, the curling control device 6 controls the curling device 5 so as to conduct the nonnip operation (e). The transfer material 8 is fed by the registration roll 4 so as to enter the transfer portion at the timing when the toner image carried on the photosensitive drum 1 is revolved into the transfer portion (d).

The transfer material 8 is revolved while being attracted and held by the transfer drum 3. After residual toner is removed from the photosensitive drum 1 by a photosensitive drum cleaning device which is not shown, the photosensitive drum 1 is again uniformly charged, and an electrostatic latent image of the second color Y. The electrostatic latent image is developed by means of Y-color toner in the developing device 2 to form a Y-color toner image. The Y-color toner image is transferred to the transfer material 8 which is caused to reach the transfer portion by the rotation of the transfer drum 3, so as to overlap the previously formed K-color toner image.

Similarly, an M-color toner image and a C-color toner image are transferred in an overlapped manner to the transfer material 8. Thereafter, the transfer material 8 is separated from the transfer drum 3 by the separation corotron 12, and then transported to the fixing device 9 in which the transfer material is subjected to the heating/pressurizing fixing operation, thereby obtaining a full-color image.

FIG. 3B shows the case where the copy operation using a transfer material which is a thick sheet is set in the mode setting means 7. The mode setting means 7 instructs the curling control device 6 to activate the nip operation mechanism 5c of the curling device 5 so that the elastic roll 5a and the hard roll 5b pressingly contact with each other to produce a curl in the transfer material 8.

At this time, in accordance with the setting of the mode setting means 7, the control device 7a instructs the main control system MCS to inhibit the image formation, i.e., the operations of writing an electrostatic latent image, developing the image by toner, and transferring the toner image, during a period when the curling device 5 operates.

When the curling device operates, the load of the motor constituting the driving system is varied. When the transfer operation is done during the curling operation, therefore, the load variation causes a pattern of lateral lines or a lateral band, i.e., so-called banding to appear in the transferred image. This phenomenon is notable particularly in the case where the driving system is provided with a single motor.

During the period when the image formation is inhibited, the transfer drum 3 is caused to make one rotation while attracting the transfer material 8 (as indicated by D in FIG. 3B) (c). Thereafter, the operations of writing an electrostatic latent image, developing the image by toner, and transferring the toner image are started in sequence.

According to the embodiment of the invention, the image quality is not impaired and hence an image of high quality can be obtained.

Figure 4:
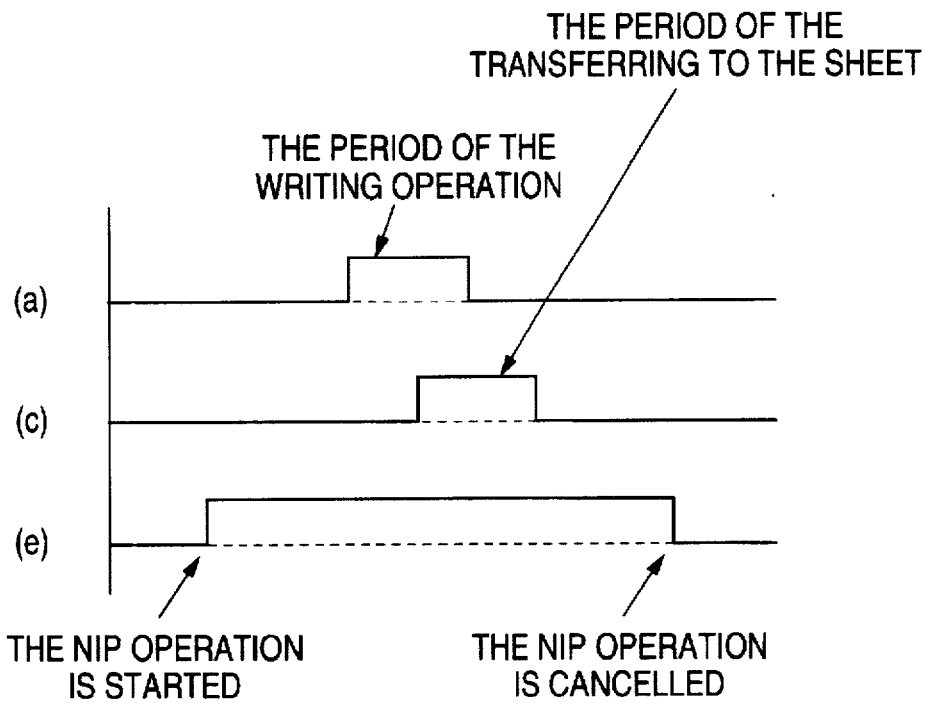
FIG. 4 is a timing chart of the main portions illustrating the operation of a second embodiment of the invention.

FIG. 4 is a timing chart of the main portions illustrating the operation of a second embodiment of the invention.

In this embodiment, in the same manner as the first embodiment, the operations of writing an electrostatic latent image, developing the image by toner, and transferring the toner image are inhibited during the curling operation. The embodiment is characterized in that, even after the curling operation is terminated and the operations of writing an electrostatic latent image and developing the image by toner (a) and the operation of transferring the toner image (c) are started, the nip operation of the curling device is continued (e) and the operation of canceling the nip operation is not executed, whereby the driving motor is prevented from being affected by the load variation.

According to this configuration, the phenomenon that banding is caused to appear in a transferred image by the load variation of the driving system does not occur, and hence an image of high quality can be obtained.

Figure 5:
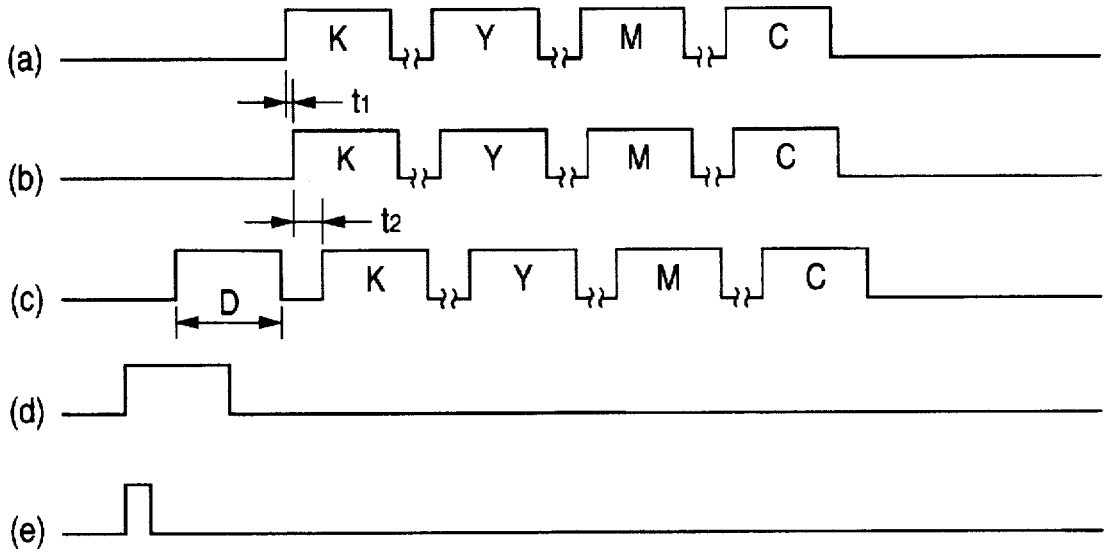
FIG. 5 is a timing chart illustrating the operation of a third embodiment of the invention.

FIG. 5 is a timing chart illustrating the operation of a third embodiment of the invention in the case where an envelope is used as the transfer material in the image forming apparatus of the invention. An envelope has a structure in which at least two thin sheets are partly overlapped and adhered with each other. Consequently, an envelope can be sufficiently tucked simply by producing a curl only in the front end portion.

In FIG. 5, formation of an electrostatic latent image (a), formation of a toner image (b) (development), the transfer operation (c), and the operation of a registration roll (d) are the same as those of the first embodiment.

In this embodiment, when the mode setting means 7 instructs that the transfer material fed into the transfer portion by the registration roll 4 is an envelope, the control device 7*a* instructs the curling control device 6 to activate the nip operation mechanism 5*c* of the curling device 5, so that the elastic roll 5*a* and the hard roll 5*b* pressingly contact with each other to produce a curl only in the front end portion of the envelope.

Figure 6:
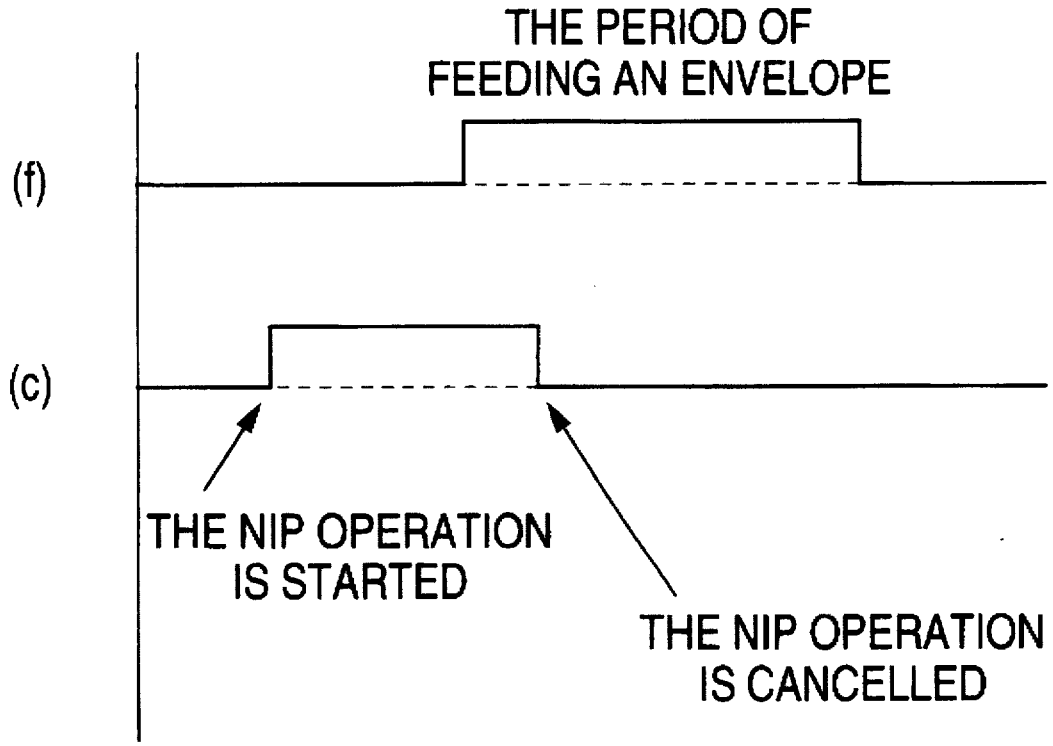
FIG. 6 is a detailed timing chart of the main portions illustrating the operation of the third embodiment of the invention in the case where a curl is produced only in the front end portion of an envelope.

FIG. 6 is a detailed timing chart of the main portions illustrating the operation of the third embodiment of the invention in the case where a curl is produced only in the front end portion of an envelope.

In FIG. 6, (f) indicates an output of a sensor (a so-called registration sensor) which detects a transfer material passing over the registration roll.

Immediately before an envelope which is used as a transfer material is fed into the transfer portion by the registration roll 4, the elastic roll 5*a* and the hard roll 5*b* of the curling device 5 are started to rotate while pressingly contacting with each other. During a period when the registration sensor detects the envelope, the press contact between the elastic roll 5*a* and the hard roll 5*b* is then canceled, thereby enabling a curl to be produced only in the front end portion of the envelope.

According to this configuration, the phenomenon that positions of images are shifted from each other in the case where an envelope is used as a transfer material does not occur, and the operation period of the curling device 5 can be shortened so that the load of the driving system is reduced.

Figure 7:
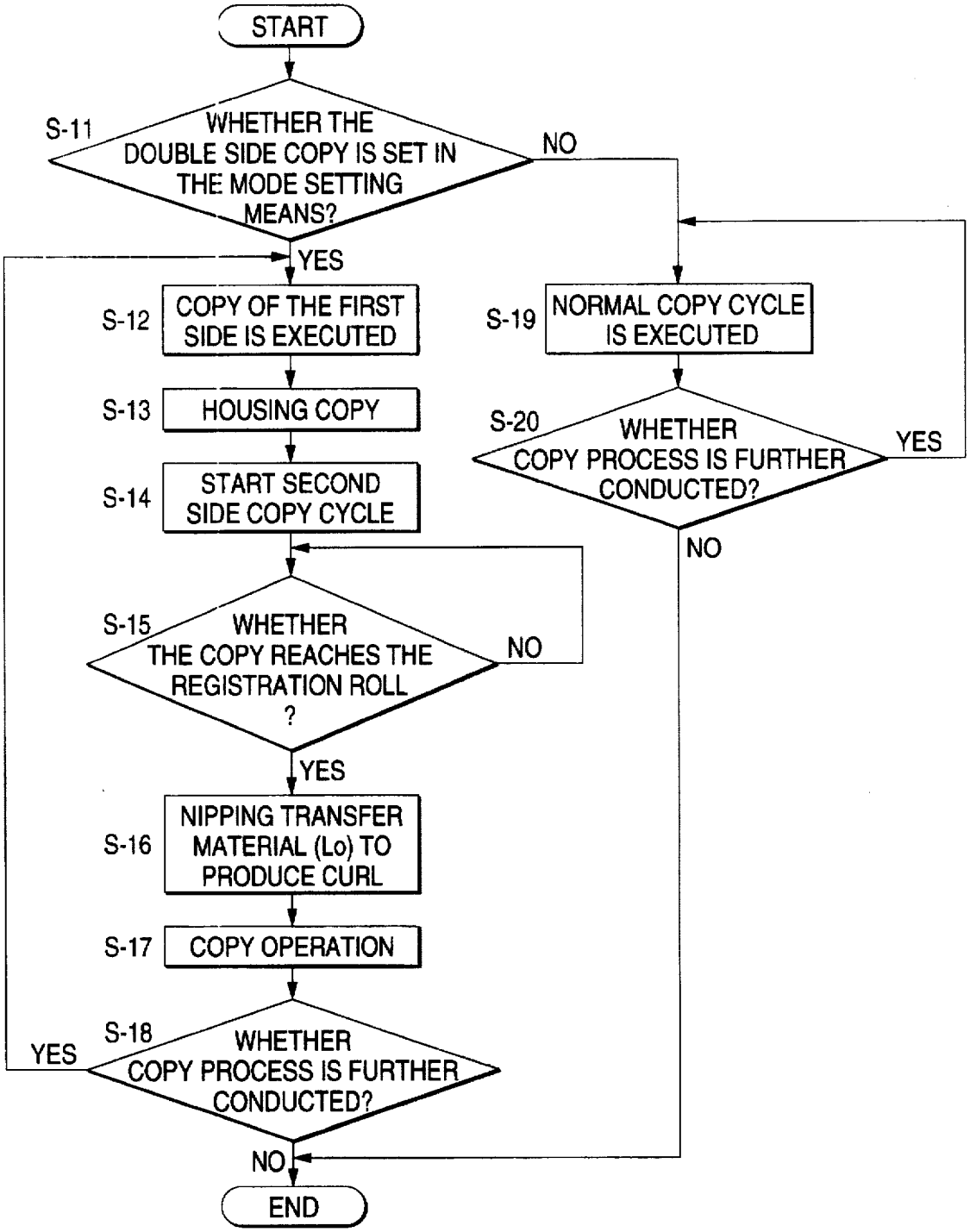
FIG. 7 is a flowchart illustrating the operation of a fourth embodiment of the invention.

FIG. 7 is a flowchart illustrating the operation of a fourth embodiment of the invention in the case where the image forming apparatus of the invention executes the double-side copy.

In FIG. 7, when the double-side copy is set in the mode setting means 7 (S-11), the copy of the first side is executed by a normal copy cycle to copy a toner image (S-12), and the transfer material 8 in which the first side has been subjected to the copy operation is once housed in the double-side copy tray 17*c* (S-13).

Thereafter, the copy cycle for the second side is started (S-14). When the transfer material 8 is taken out from the double-side copy tray 17*c* and reaches the registration roll 4 (S-15), the curling device 5 nips the transfer material 8 so that a curl is produced only in the front end portion (S-16). At this time, it is often that the transfer material 8 has deformation (waviness) due to the copy operation conducted on the first side. When a curling operation is applied on the whole region of the transfer material from the front end to the rear end under this state, the transfer material is wrinkled or the curling device causes the transfer material to be obliquely fed (skewed), thereby producing a jam in the transfer portion or distortion of a resulting image.

To comply with this, the curling process of the front end of the transfer material in step S-16 is conducted in the following manner. As described above with reference to FIG. 2, the curling control device 6 controls the nip operation mechanism of the curling device 5 so as to execute the nip operation in such a manner that the curling operation is applied only on a region which is separated from the front end of the transfer material 8 in which the second side is to be subjected to the copy operation, by a distance ($L_0$) which is shorter than the distance (L) between the curling device 5 and the portion where the image carrier 1 opposingly contacts with the transferring device 3.

The curled transfer material 8 is then subjected to the copy operation of the second side by a normal copy cycle (S-17).

Alternatively, the curled transfer material 8 may be subjected to the transfer operation after an attraction dummy cycle is performed one time.

If the copy operation is to be further conducted (S-18), the process returns to step S-12 so as to execute a similar double-side copy. If the copy operation is not required to be further conducted, the copy operation is terminated.

If a normal copy is instructed in step S-11, a normal copy cycle is executed (S-19). If the copy operation is to be further conducted (S-20), the process returns to step S-19 so as to execute a similar double-side copy. If the copy operation is not required to be further conducted, the copy operation is terminated.

Figure 8:
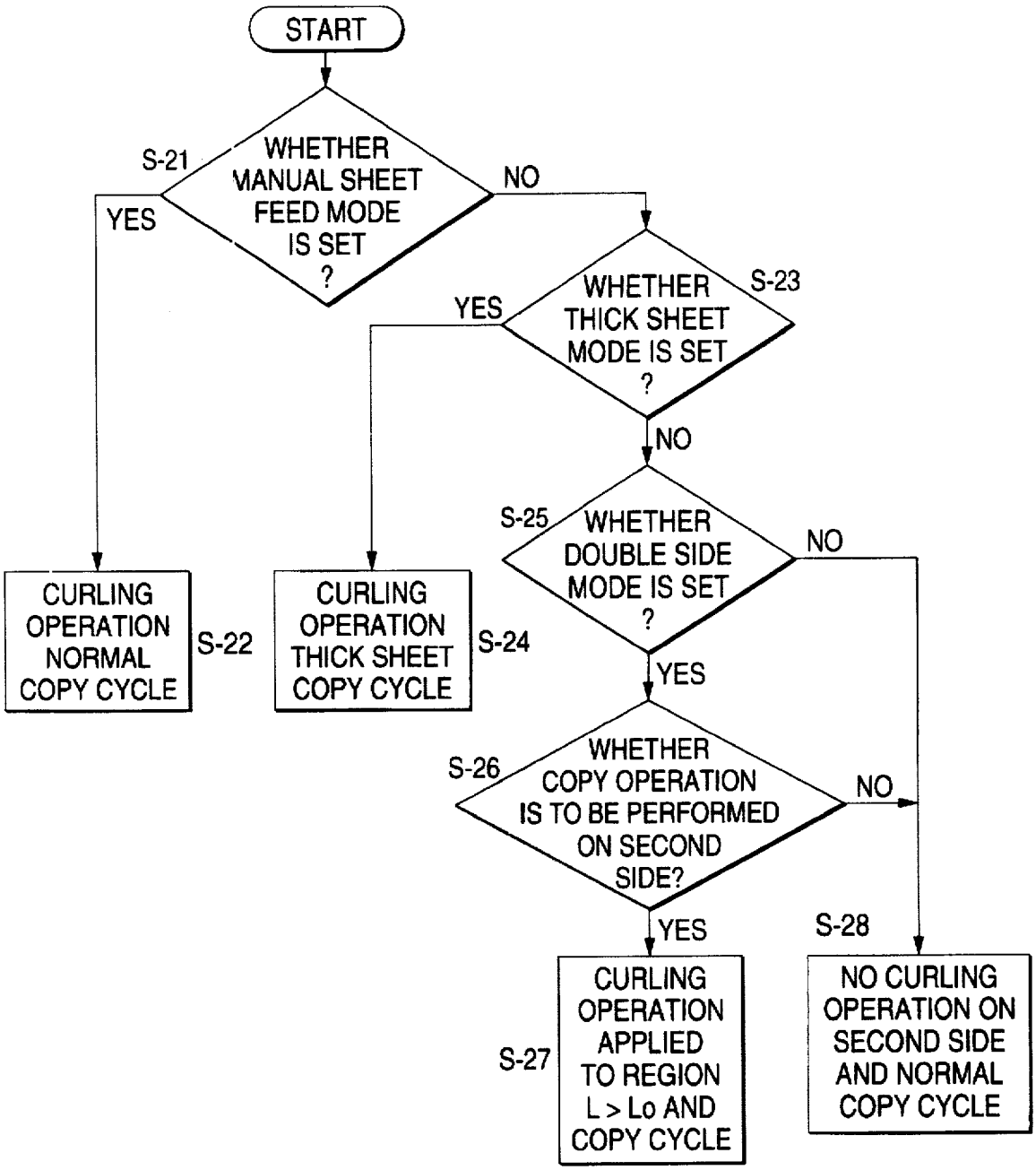
FIG. 8 is a flowchart illustrating a fifth embodiment of the control system of the image forming apparatus of the invention.

FIG. 8 is a flowchart illustrating a fifth embodiment of the image forming apparatus of the invention.

The embodiment is configured so that, in the manual sheet feed mode, transfer materials of all kinds including a thin transfer material (plain paper) and a thick transfer material are nipped and subjected to the curling operation. Even when the operator fails to set the thick sheet mode in the mode setting means 7, the curling operation is applied on the whole length of the transfer material, thereby enabling also a thick transfer material to be normally subjected to the copy operation.

If it is judged after the start of the operation of the apparatus that the manual sheet feed mode is set (Yes in step S-21), even when the thick sheet mode is failed to be set before a thick sheet is fed from the manual sheet feed tray, the rolls 5*a* and 5*b* of the curling device nip the transfer material to apply the curling operation on the whole length of the transfer material and the normal copy cycle is executed (S-22).

If the manual sheet feed mode is not set (No in step S-21), it is judged whether the thick sheet mode is set or not. If the thick sheet mode is set (Yes in step S-23), the curling device is activated so that the curling operation is applied on the whole length of the transfer material and the thick sheet copy cycle is executed (S-24).

If the thick sheet mode is not set (No in step S-23), it is judged whether the double-side copy mode is set or not (S-25). If Yes, it is further judged whether the copy operation is to be conducted on the second side or not (S-26). If Yes, the curling operation is applied only on the region of $L>L_0$, i.e., the front end portion of the transfer material and the normal copy cycle is executed (S-27).

In contrast, if it is judged in step S-25 that the double-side copy mode is not set, the process enters the normal copy cycle in which there is no nip operation or the curling operation is not conducted (S-28). Also in the case where it is judged in step S-26 that the copy operation is not for the second side, the process enters the normal copy cycle in which there is no curling operation (S-28).

According to this configuration, in the case where a thick transfer material is enabled to be fed from an automatic sheet feed tray, the curling operation is applied on the whole length of the transfer material even when the thick sheet mode is failed to be set, thereby enabling also a thick transfer material to be normally subjected to the copy operation.

Figure 9:
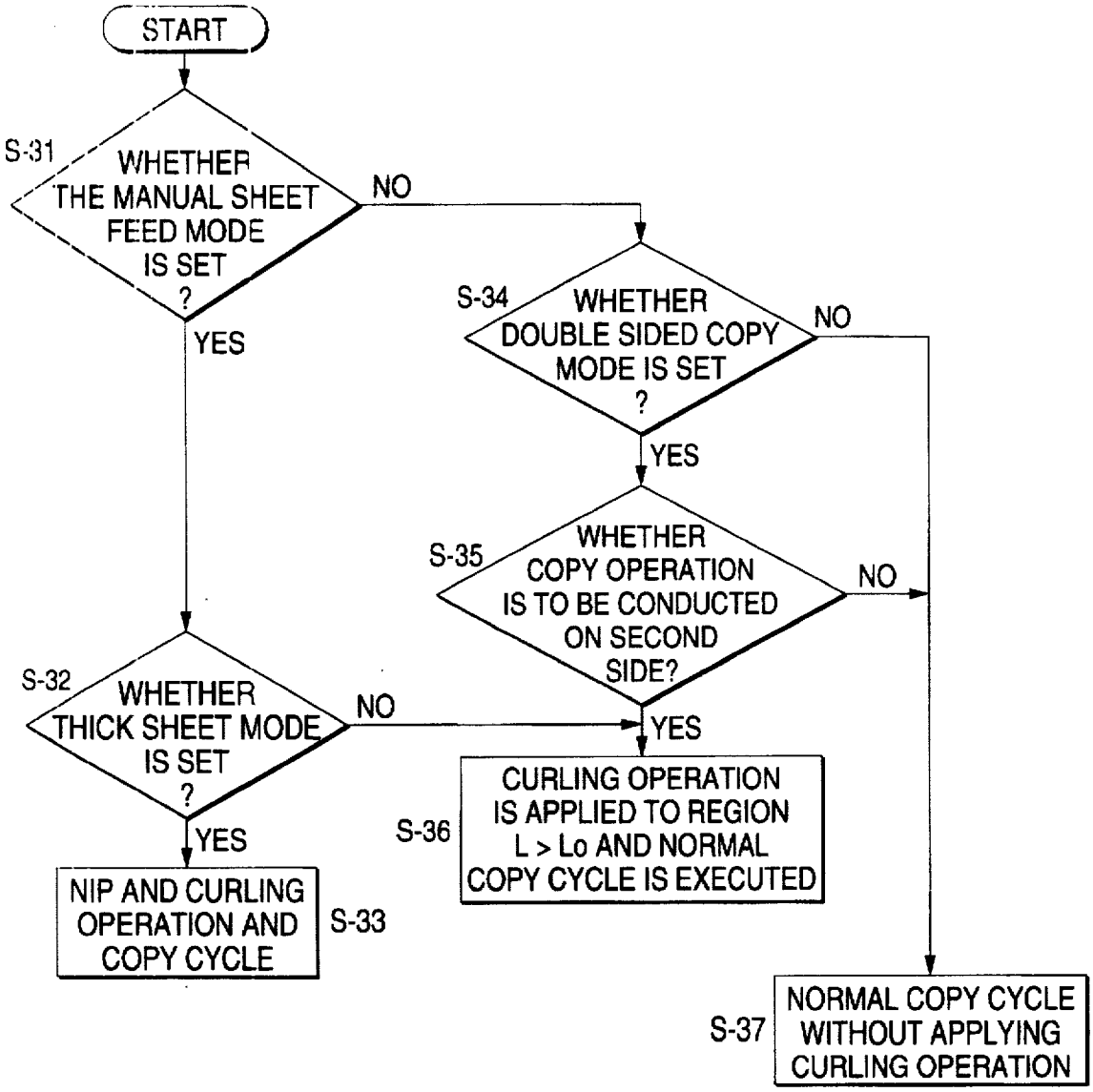
FIG. 9 is a flowchart illustrating a sixth embodiment of the control system of the image forming apparatus of the invention.

FIG. 9 is a flowchart illustrating a sixth embodiment of the image forming apparatus of the invention.

According to the embodiment, when the manual sheet feed mode is set and the thick sheet mode is not set, the curling operation is applied only on the front end portion of a transfer material, and, when the thick sheet mode is set, the curling operation is applied on the region of $L>L_0$, i.e., on the whole length of the transfer material and the normal copy cycle is executed.

If the manual sheet feed mode is set (Yes in step S-31) and the thick sheet mode is set (Yes in step S-32), the nip operation is conducted so that the curling operation is applied on the whole length, and the thick sheet copy cycle is executed (S-33).

If the manual sheet feed mode is not set, it is judged whether the double-side copy mode is set or not. If the double-side copy mode is set (Yes in step S-34), it is judged whether the copy operation is to be conducted on the second side or not (S-35). If Yes, the curling operation is applied only on the region of $L>L_0$, i.e., the front end portion of the transfer material and the normal copy cycle is executed (S-36). If the manual sheet feed mode is not set (No in step S-34), the normal copy cycle is executed without applying the curling operation (S-37).

Figure 10:
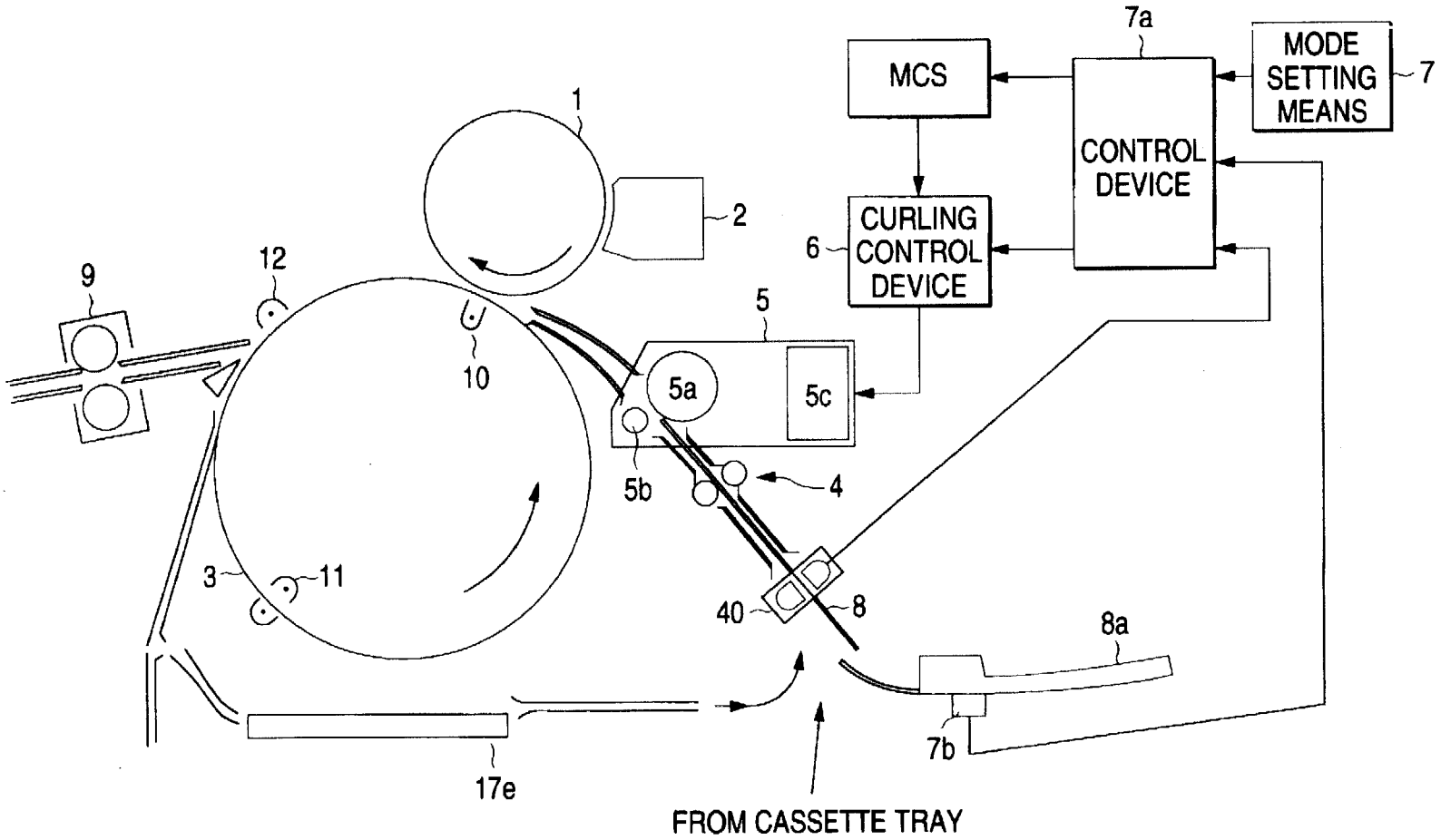
FIG. 10 is a diagram illustrating a second example of the main configuration to which the control system of the image forming apparatus of the invention is applied.

FIG. 10 is a diagram illustrating a second example of the main configuration to which the control system of the image forming apparatus of the invention is applied. The components designated by the same reference numerals as those of FIGS. 1A and 1B correspond to the components designated by them. The reference numeral 40 designates a transparentness/opaqueness sensor.

The configuration of FIG. 10 is the same as that of FIGS. 1A and 1B except that the transparentness/opaqueness sensor 40 for detecting whether a transfer material is transparent or not is disposed upstream of the registration roll 4.

Preferably, the transparentness/opaqueness sensor 40 is a transmission optical sensor. Alternatively, the sensor may not be an optical sensor, or may be of the reflection type in place of the transmission type as far as the sensor can detect the transparentness/opaqueness of a transfer material.

When the transparentness/opaqueness sensor 40 detects that the transfer material fed to the registration roll is transparent, the sensor supplies a detection signal to the curling control device 6 so that the nip operation of the curling device is inhibited. When the sensor detects that the transfer material is opaque, the curling device is controlled in accordance with the conditions, i.e., the manual sheet feed mode is set, or the double-side copy mode is set. Hereinafter, an operation example in which the above-mentioned configuration is used will be described with reference to flowcharts.

Figure 11:
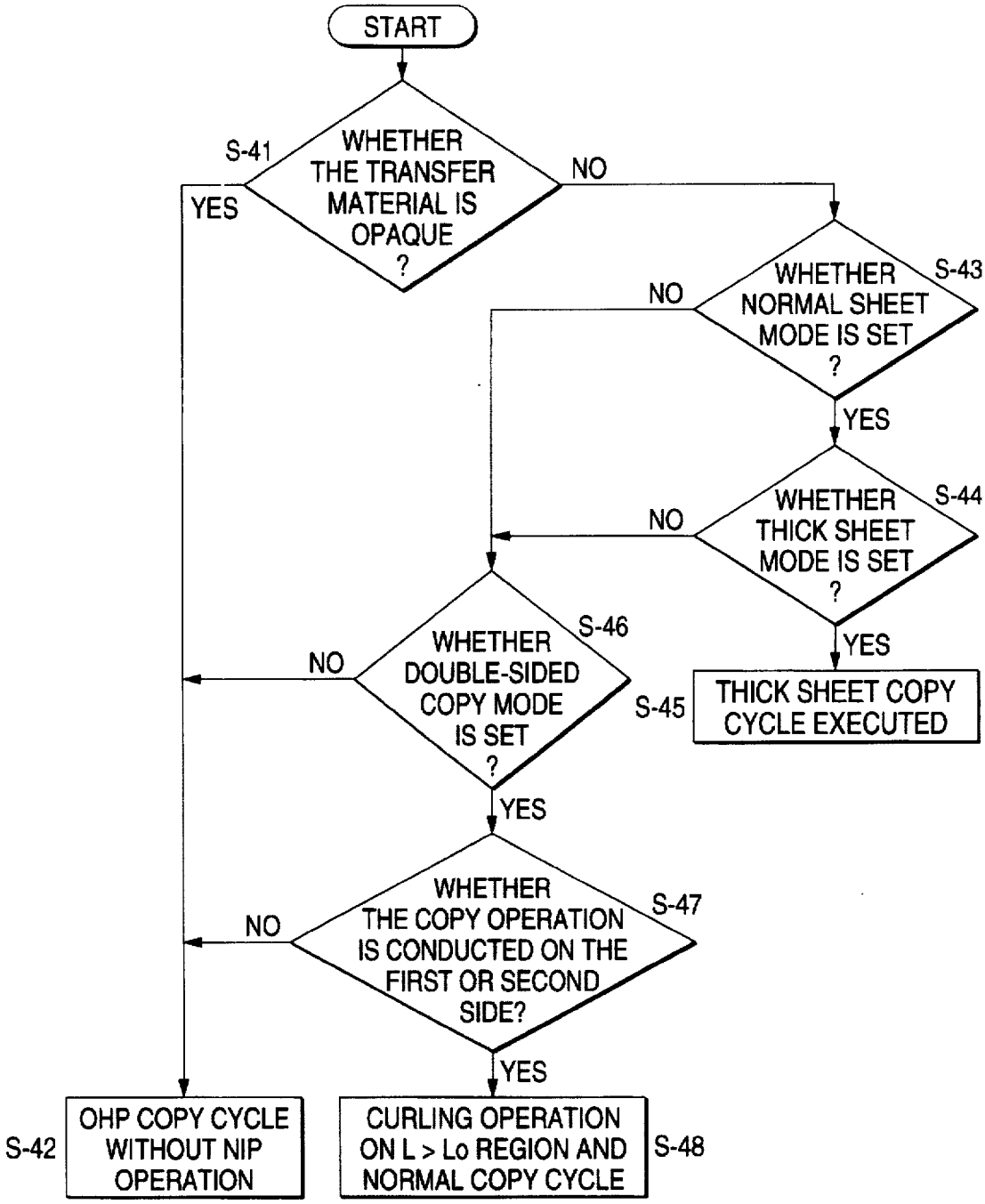
FIG. 11 is a flowchart illustrating the operation of a seventh embodiment of the invention which uses the configuration of FIG. 10.

FIG. 11 is a flowchart illustrating the operation of a seventh embodiment of the invention which uses the configuration of FIG. 10.

It is judged after the start of the operation of the apparatus whether the fed transfer material is transparent or not. If the transfer material is transparent (Yes in step S-41), typically, it is an OHP sheet, an OHP copy cycle is executed without applying the curling operation (S-42).

In contrast, if the transfer material is opaque (No in step S-41), it is judged whether the manual sheet feed mode is set or not (S-43). If the manual sheet feed mode and the thick sheet mode are set (Yes in step S-44), the nip operation is conducted so that the curling operation is applied on the whole length of the transfer material, and the thick sheet copy cycle is executed (S-45).

If the manual sheet feed mode is not set, it is judged whether the double-side copy mode is set or not (S-46). If No, the OHP copy cycle without the nip operation is executed (S-42). If the double-side copy mode is set, it is judged whether the copy operation is to be conducted on the first side or the second side (S-47). If the copy operation is to be conducted on the first side, the OHP copy cycle without the nip operation is executed (S-42). If the copy operation is to be conducted on the second side, the curling operation is applied only on the region of $L>L_0$, i.e., the front end portion of the transfer material and the normal copy cycle is executed (S-48).

If it is judged in step S-44 that the thick sheet mode is set, the thick sheet mode is executed in which the nip operation is conducted so that the curling operation is applied on the whole length of the transfer material (S-45).

In this embodiment, when an OHP sheet is used as a transfer material, the curling operation is not applied, and, when a thick transfer material is used, the curling operation is applied on the whole length and the copy cycle is executed, whereby an OHP sheet and a thick sheet fed from the manual sheet feed tray are subjected to the copy operation in different manners.

The transparentness/opaqueness sensor may be disposed in an apparatus in which an OHP sheet is fed from an automatic sheet feed tray. Also in this case, When the apparatus is controlled in the same manner as described above, the copy operation can be executed on the OHP sheet without applying the curling operation.

Figure 12:
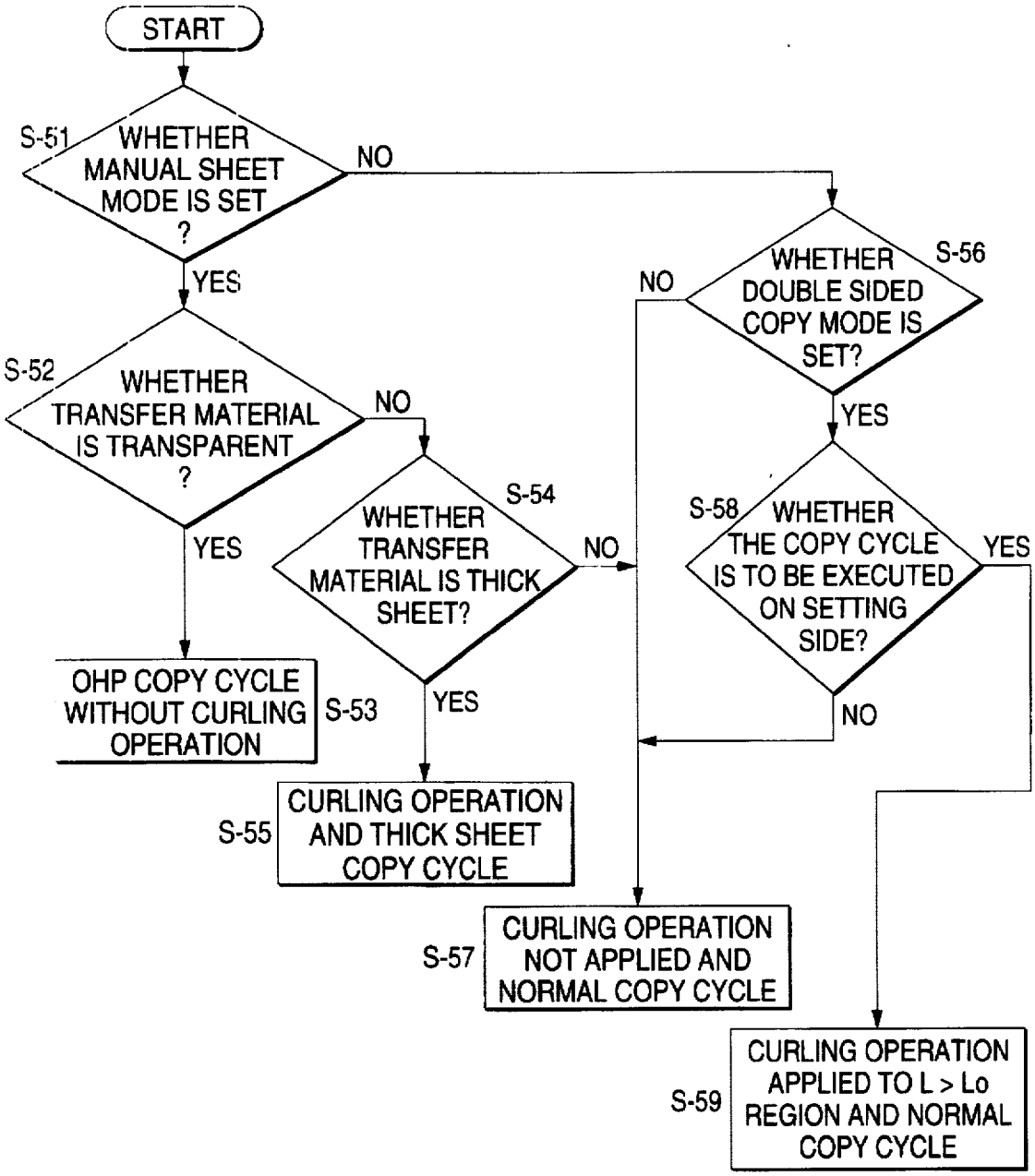
FIG. 12 is a flowchart illustrating the operation of an eighth embodiment of the invention which uses the configuration of FIG. 10.

FIG. 12 is a flowchart illustrating the operation of an eighth embodiment of the invention which uses the configuration of FIG. 10.

In FIG. 12, if it is judged after the start of the operation of the apparatus that the manual sheet feed mode is set (Yes in step S-51) and the transfer material is transparent (Yes in step S-52), the OHP copy cycle is executed without applying the curling operation (S-53). If the transfer material is opaque, it is judged whether the transfer material is a thick sheet or not (S-54). If it is a thick sheet, the rolls of the curling device are caused to conduct the nip operation so that the curling operation is applied on the whole length of the transfer material, and the thick sheet copy cycle is executed (S-55). If the transfer material is not a thick sheet, the curling operation is not applied and the normal copy cycle is executed (S-57).

If the manual sheet feed mode is not set, it is judged whether the double-side copy mode is set or not (S-56). If the double-side copy mode is not set, the curling operation is not applied and the normal copy cycle is executed (S-57). If the double-side copy mode is set, it is judged whether the copy operation is to be conducted on the second side or not (S-58). If the copy operation is not to be conducted on the second side, the curling operation is not applied and the normal copy cycle is executed (S-57). If the copy operation is to be conducted on the second side, the curling operation is applied only on the region of $L>L_0$, i.e., the front end portion of the transfer material and the normal copy cycle is executed (S-59).

According to this configuration, if the transfer material is an OHP sheet, the curling device is not activated, and, if the transfer material is judged as a thick sheet, the curling operation can be applied on the whole length of the transfer material.

Figure 13:
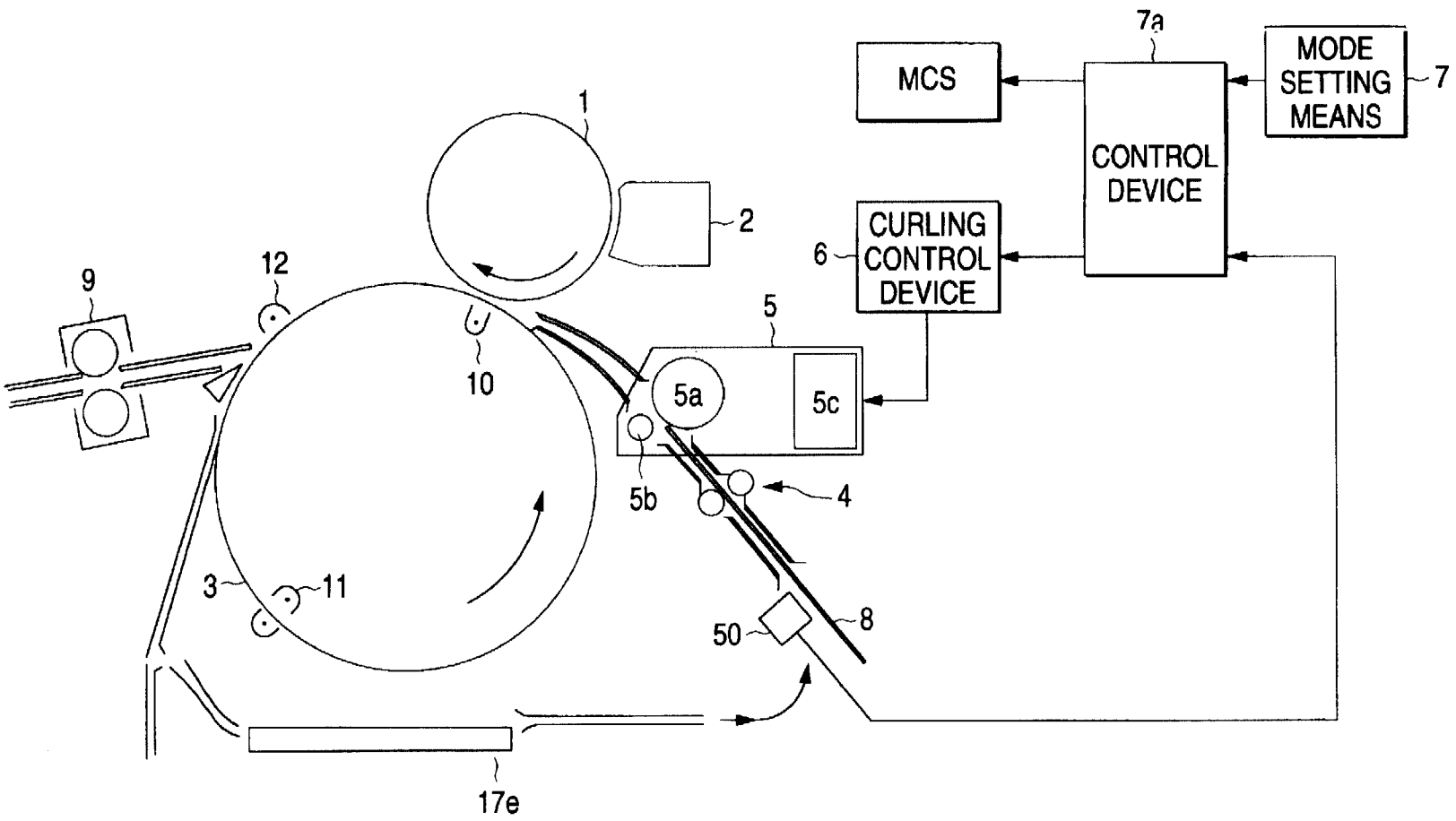
FIG. 13 is a diagram illustrating a third example of the main configuration to which the control system of the image forming apparatus of the invention is applied.

FIG. 13 is a diagram illustrating a third example of the main configuration of the image forming apparatus of the invention. The components designated by the same reference numerals as those of FIG. 10 correspond to the components designated by them. The reference numeral 50 designates a back-side sensor.

The configuration of FIG. 13 is the same as that of FIGS. 1A and 1B except that the back-side sensor 50 for detecting whether an image exists on the back side of a transfer material or not is disposed upstream of the registration roll 4. Preferably, the back-side sensor 50 is a reflection optical sensor. Alternatively, the sensor may be of the transmission type.

When the transparentness/opaqueness sensor 40 shown in FIG. 10 is of the reflection type, it may be used as the back-side sensor 50. An existing transfer material size detection sensor (not shown) may be used as the back-side sensor.

The back-side sensor detects whether an image is formed on the back side of a transfer material or not. The sensor of the reflection type comprises plural sets of a light emitting device and a light receiving device which are arranged in the image area for a transfer material so as to cross the transportation direction of the transfer material. The light receiving devices receive light which is emitted from the light emitting devices and reflected from the transfer material. Depending on the levels of the signals of the devices (the background level and the level of the image area), existence of an image is detected.

When the back-side sensor 50 detects that an image is formed on the transfer material fed to the registration roll, it is recognized that the double-side copy cycle is to be conducted. The detection signal is fed to the curling control device 6 so that the curling device conducts the nip operation. If the thick sheet mode is not set, the curling operation is applied only on the front end portion of the transfer material, and, if the thick sheet mode is set, the curling operation is applied on the whole length of the transfer material.

Hereinafter, an operation example in which the above-mentioned configuration is used will be described with reference to a flowchart.

Figure 14:
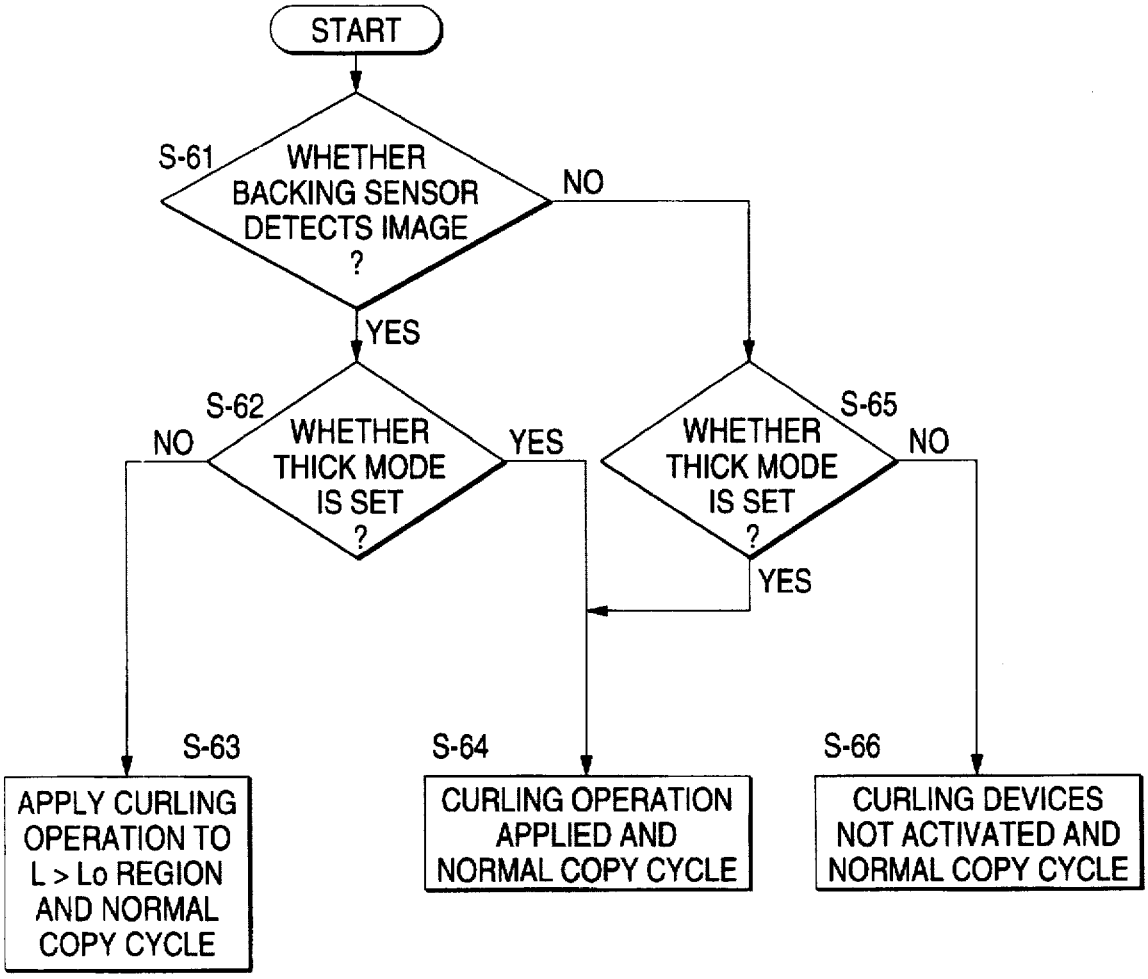
FIG. 14 is a flowchart illustrating the operation of a ninth embodiment of the invention which uses the configuration of FIG. 13.

FIG. 14 is a flowchart illustrating the operation of a ninth embodiment of the invention which uses the configuration of FIG. 13.

In FIG. 14, if it is judged after the start of the operation of the apparatus that the back-side sensor detects existence of an image (S-61), it is judged that the transfer material is the second side of the double-side copy mode, and the process proceeds to a judgment step (S-62) in which it is judged whether the thick sheet mode is set or not.

If it is judged in step S-62 that the thick sheet mode is not set, the curling operation is applied only on the region of $L>L_0$, i.e., the front end portion of the transfer material and the normal copy cycle is executed (S-63).

If the thick sheet mode is set (Yes in step S-62), the curling operation is applied on the whole length of the transfer material, and the thick sheet copy cycle is executed (S-64).

In contrast, if the output indicative of existence of an image is not output from the back-side sensor, it is judged that the single-side copy mode is set or the transfer material is the first side of the double-side copy mode, and the process proceeds to a judgment step (S-65) in which it is judged whether the thick sheet mode is set or not.

If it is judged in step S-65 that the thick sheet mode is set (Yes in step S-65), the curling device is activated so that the curling operation is applied on the whole length of the transfer material. If it is judged in step S-65 that the thick sheet mode is not set (No in step S-65), the curling device is not activated and the normal copy cycle is executed (S-66).

As described above, in accordance with the detection of existence of an image on the back side of a transfer material, it is judged whether the transfer material is the second side of the double-side copy mode or not. Therefore, it is not required to particularly set the double-side copy mode. This configuration can be realized irrespective of the type of the feed source of a transfer material, i.e., in either of a manual sheet feed tray or an automatic sheet feed tray. In a system wherein the copy operation of a thick sheet is conducted only by feeding the sheet from a manual sheet feed tray, the judgment on the thick sheet mode is not necessary, and the process may enter the curling process of step S-63 or the normal copy cycle without the curling operation of step S-66, depending only on the output of the back-side sensor.

Hereinafter, the configuration of the main portions of an image forming apparatus to which the above-described embodiments of the invention may be applied will be described.

Figure 15:
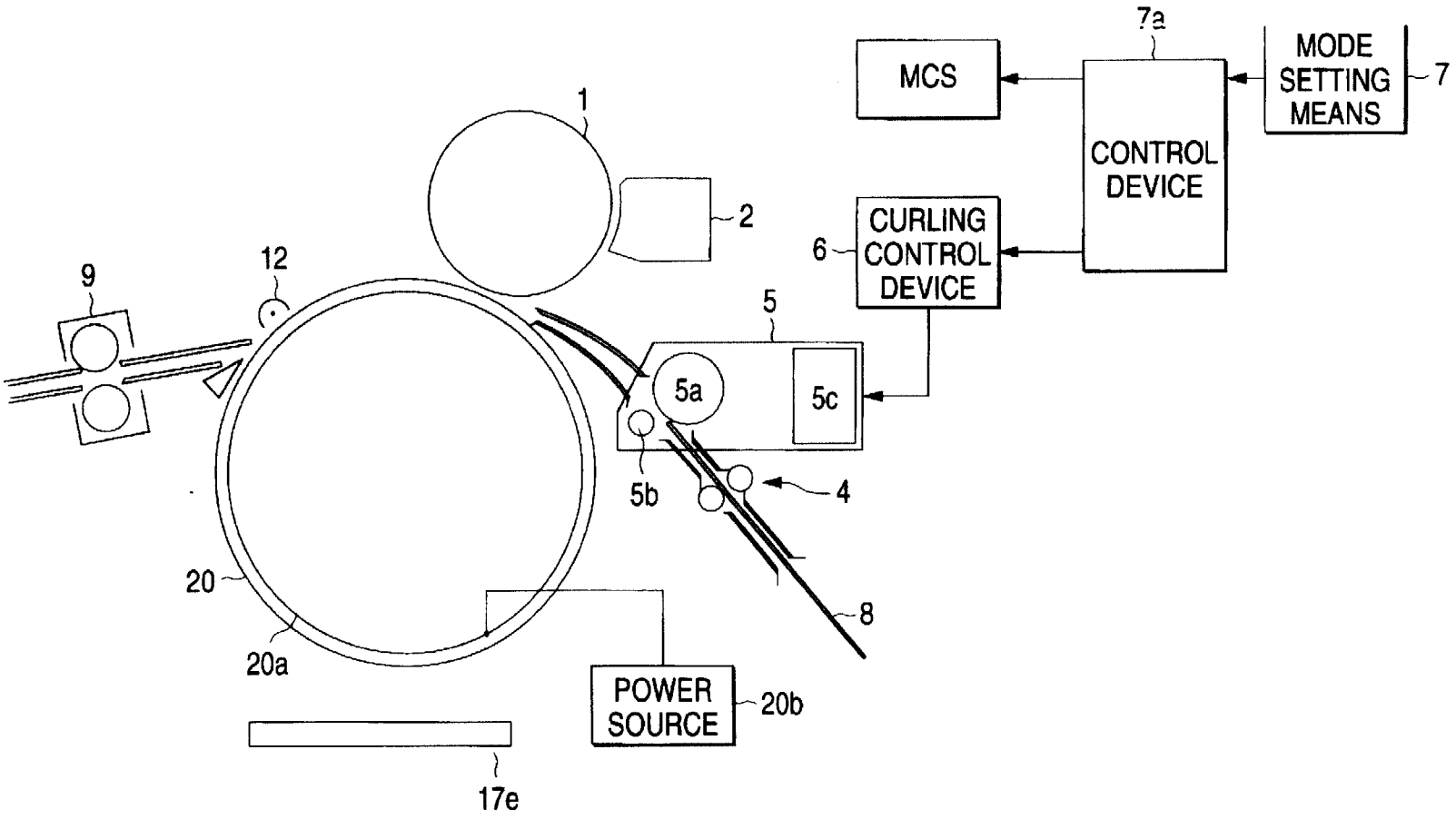
FIG. 15 is a diagram illustrating a fourth example of the control system of the image forming apparatus of the invention.

FIG. 15 is a diagram illustrating a fourth example of the configuration of the image forming apparatus of the invention. The components designated by the same reference numerals as those of FIGS. 1A and 1B correspond to the components designated by them. The reference numeral 20 designates a transfer drum, 20*a* designates an electrically conductive layer, and 20*b* designates a power source for transfer.

In FIG. 15, static electricity is uniformly applied to the surface of the photosensitive drum 1 by a charging device which is not shown, and then an electrostatic latent image is formed by using a light beam such as a laser beam which is modulated by an image signal. The light beam is subjected to the main scanning by an optical scanning system having a polygon mirror, etc., and to a subscanning by the rotation of the photosensitive drum.

When the photosensitive drum 1 is rotated to the position of the developing device 2, the developing device 2 develops the electrostatic latent image formed on the surface of the photosensitive drum 1 by using toner, thereby forming a toner image.

When the photosensitive drum 1 is further rotated, the drum reaches the transfer portion where it opposingly contacts with the transfer drum 20. The transfer drum 20 opposingly contacts with the photosensitive drum 1 and transfers the toner image carried on the photosensitive drum 1 to the transfer material 8 fed between the transfer drum and the photosensitive drum 1.

On the other hand, the registration roll 4 which provides a timing of feeding the transfer material 8 transported from a transfer material tray (not shown) to the transfer portion is disposed upstream of the transfer portion. The registration roll nips the front end of the transfer material 8 transported from the transfer material tray so that the transfer material is once stopped, and then feeds the transfer material 8 to the transfer portion at a predetermined timing when the toner image on the photosensitive drum 1 reaches the transfer portion.

The transfer drum 20 has the conductive rubber layer 20*a* on the surface. A predetermined transfer potential is applied from the transfer power source 20*b* to the conductive rubber layer 20*a* so that the toner image on the photosensitive drum 1 is transferred to the transfer material 8.

The curling device 5 which is disposed between the transfer portion and the registration roll 4 consists of the larger elastic roll 5*a*, the smaller hard roll 5*b*, and the nip operation mechanism 5*c* which conducts a nip operation of producing a curl in the transfer material 8 passing between the elastic roll 5*a* and the hard roll 5*b* and an operation of canceling the nip operation.

The curling device 5 is controlled by the curling control device 6. In accordance with the thick sheet mode, or the envelope mode which is set in the mode setting means 7, the curling control device 6 controls the curling device 5 so as to conduct the nip operation.

As a result of nipping the transfer material 8 by the nip operation, a curl which is curved in the same direction as the transfer drum 20 is produced in the whole of the transfer material 8 from the front end to the rear end, or the front end region of the material, and a dummy transfer period when, during the nip operation, the image formation of the transfer drum 20 is stopped is set. The control of the nip operation mechanism 5*c* based on the setting of the mode setting means 7 is performed in the same manner as that of FIGS. 1A and 1B.

According to this configuration, the transfer material and a toner image are prevented from being positionally shifted from each other so that an image of high quality is formed, and the operation period of the curling device 5 can be shortened so that the load of the driving system is reduced.

Figure 16:
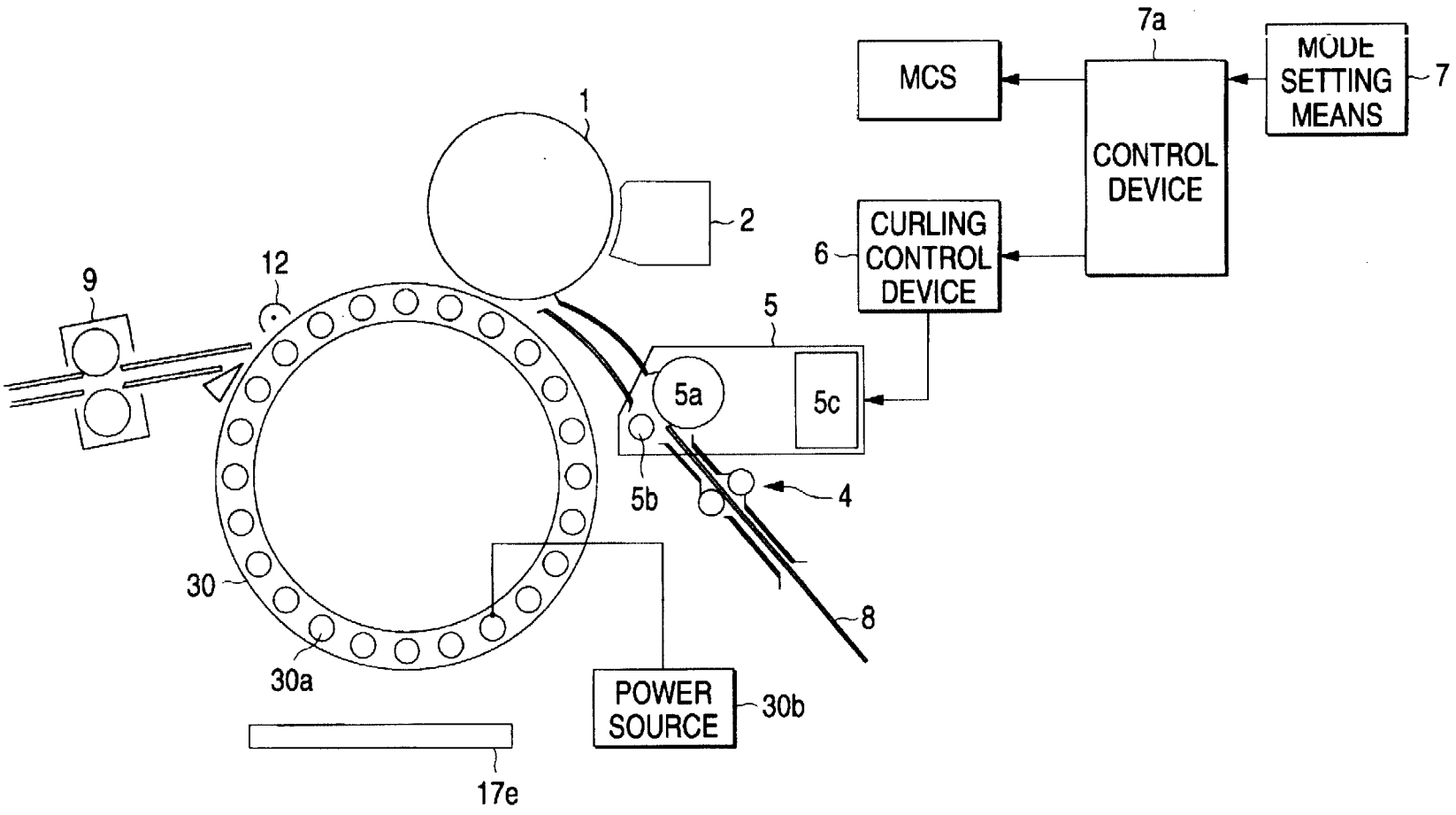
FIG. 16 is a diagram illustrating a fifth example of the control system of the image forming apparatus of the invention.

FIG. 16 is a diagram illustrating the main portions of a fifth example of the image forming apparatus of the invention. The components designated by the same reference numerals as those of FIG. 15 correspond to the components designated by them. The reference numeral 30 designates a transfer drum, 30*a* designates electrodes, and 30*b* designates a power source for transfer.

In FIG. 16, static electricity is uniformly applied to the surface of the photosensitive drum 1 by a charging device which is not shown, and then an electrostatic latent image is formed by using a light beam such as a laser beam which is modulated by an image signal. The light beam is subjected to the main scanning by an optical scanning system having a polygon mirror, etc., and to a subscanning by the rotation of the photosensitive drum.

When the photosensitive drum 1 is rotated to the position of the developing device 2, the developing device 2 develops the electrostatic latent image formed on the surface of the photosensitive drum 1 by using toner, thereby forming a toner image.

When the photosensitive drum 1 is further rotated, the drum reaches the transfer portion where it opposingly contacts with the transfer drum 30. The transfer drum 30 opposingly contacts with photosensitive drum 1 and transfers the toner image carried on the photosensitive drum 1 to the transfer material 8 fed between the transfer drum and the photosensitive drum 1.

On the other hand, the registration roll 4 which provides a timing of feeding the transfer material 8 transported from a transfer material tray (not shown) to the transfer portion is disposed upstream of the transfer portion. The registration roll nips the front end of the transfer material 8 transported from the transfer material tray so that the transfer material is once stopped, and then feeds the transfer material 8 to the transfer portion at a predetermined timing when the toner image on the photosensitive drum 1 reaches the transfer portion.

The transfer drum 30 has a number of electrodes 30*a* embedded in an insulating layer on the surface. A predetermined transfer potential is applied from the transfer power source 30*b* to the electrodes 30*a* so that the toner image on the photosensitive drum 1 is transferred to the transfer material 8.

The curling device 5 which is disposed between the transfer portion and the registration roll 4 consists of the larger elastic roll 5*a*, the smaller hard roll 5*b*, and the nip operation mechanism 5*c* which conducts a nip operation of producing a curl in the transfer material 8 passing between the elastic roll 5*a* and the hard roll 5*b* and an operation of canceling the nip operation.

The curling device 5 is controlled by the curling control device 6. In accordance with the thick sheet mode, or the envelope mode which is set in the mode setting means 7, the curling control device 6 controls the curling device 5 so as to conduct the nip operation.

As a result of nipping the transfer material 8 by the nip operation, a curl which is curved in the same direction as the transfer drum 30 is produced in the whole of the transfer material 8 from the front end to the real end, or the front end region of the material, and a dummy transfer period when, during the nip operation, the image formation of the transfer drum 30 is stopped is set. The control of the nip operation mechanism 5*c* based on the setting of the mode setting means 7 is performed in the same manner as that of FIGS. 1A and 1B.

According to this configuration, the transfer material and a toner image are prevented from being positionally shifted from each other so that an image of high quality is formed, and the operation period of the curling device 5 can be shortened so that the load of the driving system is reduced.

Next, examples of the configuration of the curling device which is used in the image forming apparatus of the embodiments will be described in detail.

Figure 17:
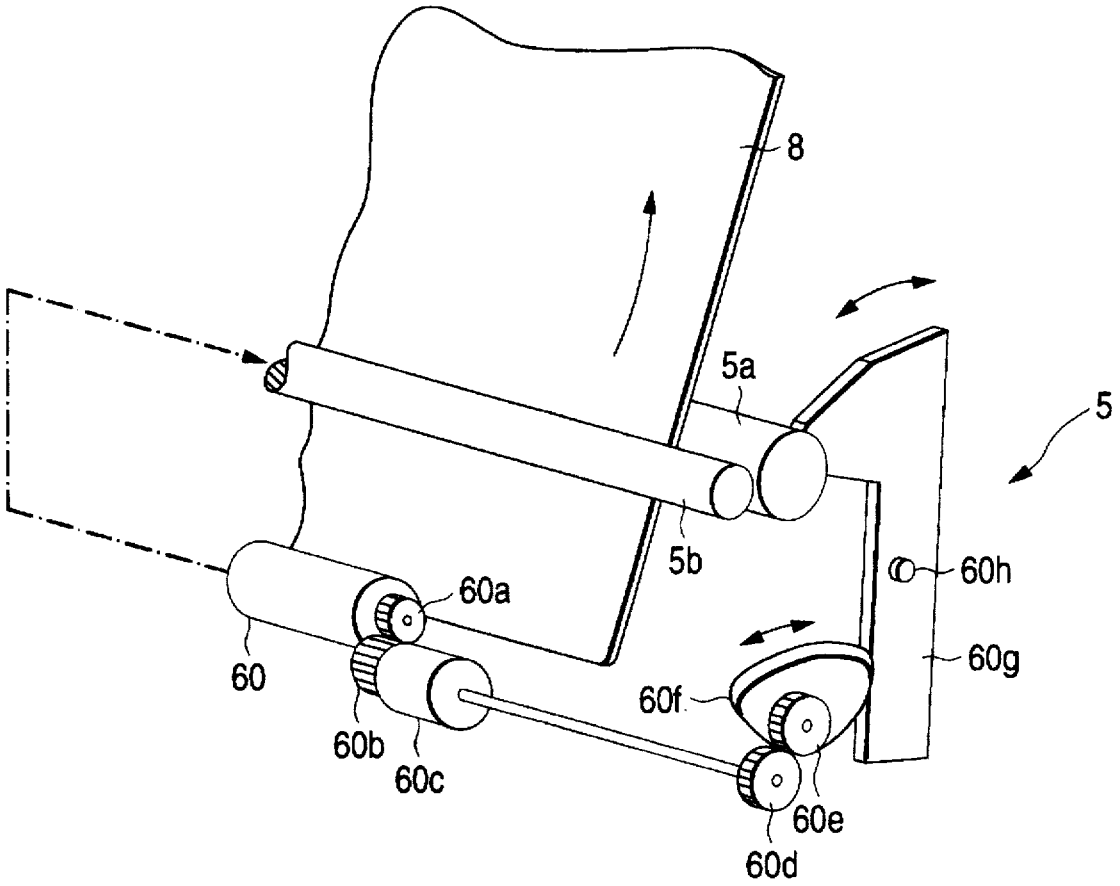
FIG. 17 is a diagrammatic perspective view illustrating the main portions of an example of the configuration of a curling device which is used in the invention.

FIG. 17 is a diagrammatic perspective view illustrating the main portions of an example of the configuration of the curling device which is used in the invention. The reference numeral 5 designates the curling device, 5*a* designates the larger elastic roll, 5*b* designates the smaller hard roll, 60 designates a driving motor, 60*a* designates a motor gear, 60*b* designates a gear on the side of a clutch, 60*c* designates an electromagnetic clutch, 60*d* designates a gear for driving a cam, 60*e* designates a gear on the side of a cam, 60*f* designates an eccentric cam, 60*g* designates a cam-follower link, 60*h* designates a rocking fulcrum, and 8 designates the transfer material.

In. FIG. 17, the curling device 5 is configured so that the larger elastic roll 5*a* is pressed against the hard roll 5*b* by the cam-follower link 60*g* which is rocked by the eccentric cam 60*f*, thereby producing a curl in the transfer material 8.

The rotation of the driving motor 60 is transmitted to the electromagnetic clutch 60*c* via the clutch gear 60*b* engaging with the motor gear 60*a*, and the cam gear 60*e* fixed to the eccentric cam 60*f* is driven by the cam-driving gear 60*d*, whereby the eccentric cam 60*f* is rotated. The rotation of the eccentric cam 60*f* causes the cam-follower link 60*g* to be rocked about the rocking fulcrum 60*h* as the fulcrum and the larger elastic roll 5*a* is pressed against the hard roll 5*b* so as to nip the transfer material 8.

The nip operation is executed by controlling the nip operation mechanism 5*c* under the control of the curling control device 6 which is done by the control device 7*a* on the basis of the setting of the mode setting means 7.

The driving motor 60 is used also as the driving source for the hard roll 5*b* of the curling device, and other mechanisms such as the photosensitive drum and the transfer drum.

Figure 18:
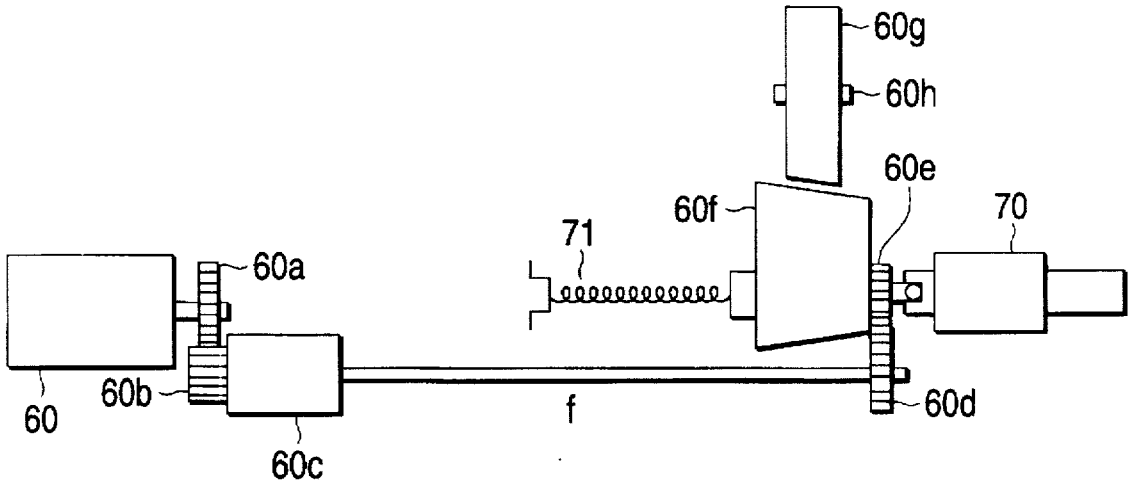
FIG. 18 is a diagrammatic perspective view illustrating the main portions of an example of the configuration of the curling device configured so that, when the power is shut down during a period when the curling device nips a transfer material, the nip operation is canceled.

FIG. 18 is a diagrammatic perspective view illustrating the main portions of an example of the configuration of the curling device configured so that, when the power is shut down during a period when the curling device nips the transfer material, the nip operation is canceled. The components designated by the same reference numerals as those of FIG. 17 correspond to the components designated by them. The reference numeral 70 designates an electromagnetic solenoid, and 71 designates a tension spring.

In FIG. 18, the whole configuration is substantially identical with that of FIG. 17, but the cam face of the eccentric cam 60*f* and the face of the cam-follower 60*g* which contacts with the cam are formed as slanting faces so that the eccentric cam 60*f* can smoothly move for the cancellation (the slanting faces are not essential in the invention).

The operating rod of the electromagnetic solenoid 70 is connected to the side of the eccentric cam 60*f* where the cam gear 60*e* is disposed, and the opposite side is urged by the tension spring 71. The electromagnetic solenoid 70 is energized by turning on the main power source of the image forming apparatus, and usually holds the eccentric cam 60*f* to the illustrated state.

Under this state, the nip and nonnip operations of the curling device are executed as described above.

Figure 19:
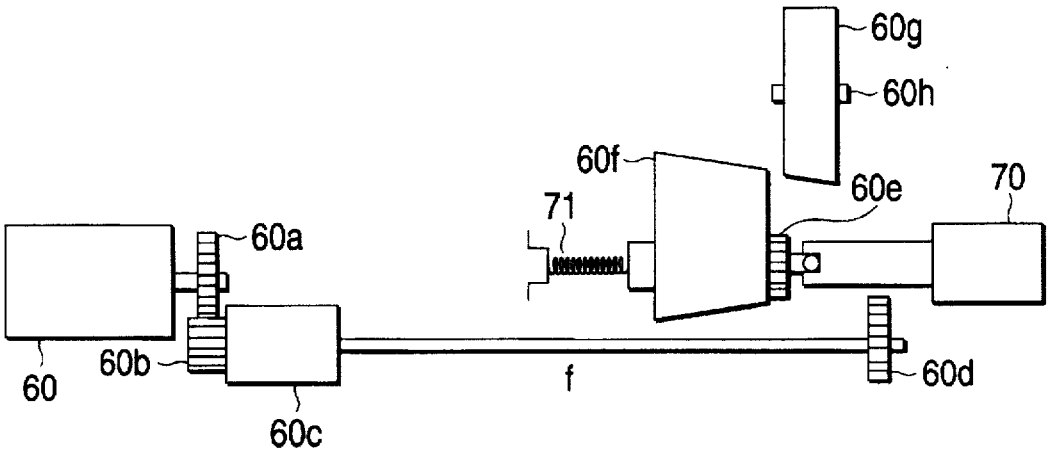
FIG. 19 is a diagrammatic perspective view illustrating the nip cancellation operation which is done in the configuration of FIG. 18 when the power is shut down.

FIG. 19 is a diagrammatic perspective view illustrating the nip cancellation operation which is done in the configuration of FIG. 18 when the power is shut down.

In FIG. 19, when the power is shut down during a period when the curling device nips the transfer material, also the electromagnetic solenoid 70 is deenergized and the operating rod of the solenoid is liberated so that the eccentric cam 60*f* is separated from the cam-follower 60*g* by the tension spring 71.

Therefore, the pressing of the larger elastic roll 5*a* shown in FIG. 10 against the hard roll 5*b* is canceled so that the nipping of the transfer material 8 canceled.

According to this configuration, it is possible to prevent the pressing of the registration roll 4 from causing a jam between the roll and the curling device 5 when the power source is shut down during the travel of the transfer material 8, and when the power is again turned on. Furthermore, the larger elastic roll 5*a* can be prevented from being deformed as a result of continuation of the nip state for a long term.

According to this configuration, the nip operation described in the embodiments of the invention can be executed so that the transfer material and a toner image formed on the photosensitive drum are prevented from being positionally shifted from each other, thereby enabling an image of high quality to be formed.

Figure 20B:
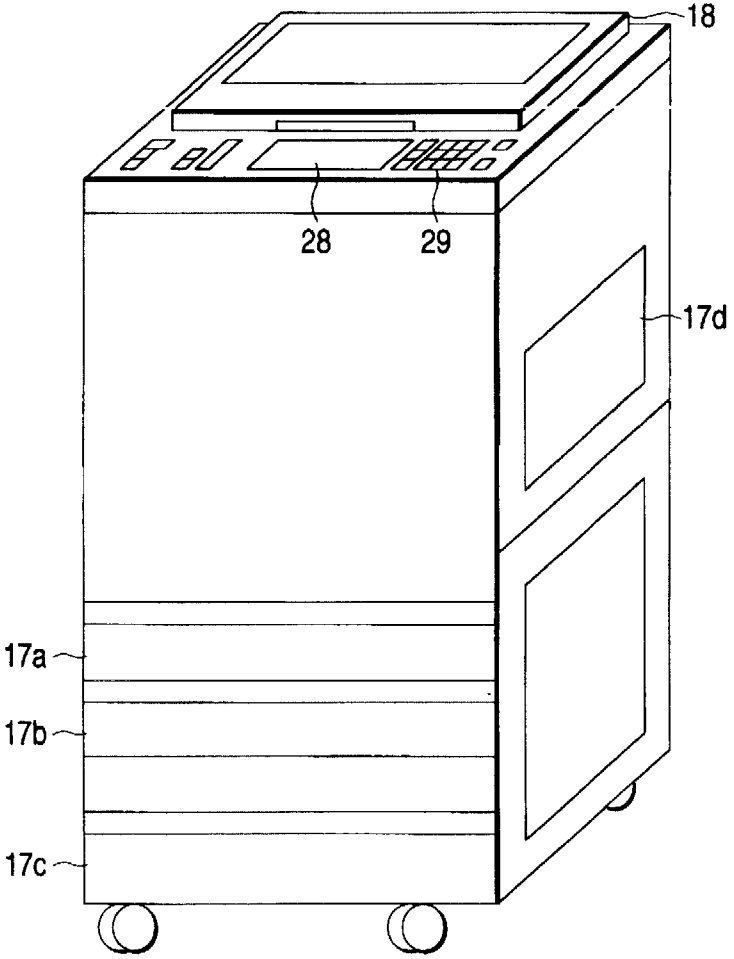
FIGS. 20A and 20B are diagrams illustrating an example of the whole configuration of the image forming apparatus to which the invention is applied.
Figure 20A:
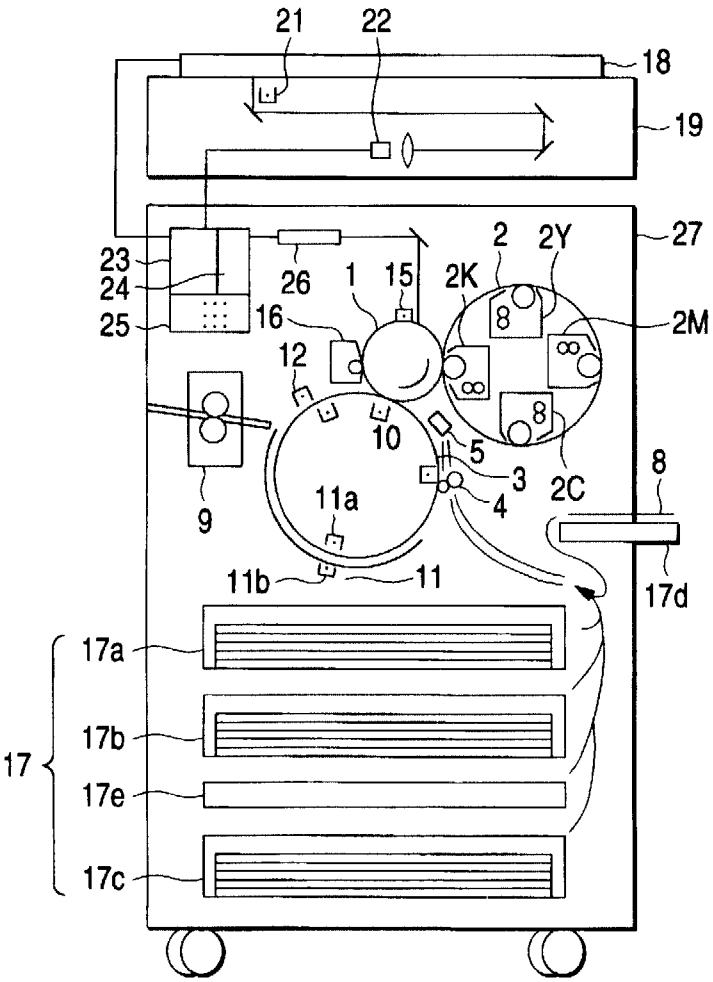

FIGS. 20A and 20B are diagrams illustrating an example of the whole configuration of the image forming apparatus to which the invention is applied. FIG. 20A is a diagram of the internal structure, and FIG. 20B is an external perspective view.

In FIGS. 20A and 20B, 1 designates the photosensitive drum, 2 designates the developing device, 3 designates the transfer drum, 8 designates the transfer material, 9 designates the fixing device, 10 designates the transfer corotron, 11 designates the discharge corotron, 12 designates the separation corotron, 15 designates a charging device, 16 designates a cleaning device, 17 designates a transfer material tray, 18 designates an edition information input device, 19 designates an image information input device (original-scanning device), 21 designates an exposure lamp, 22 designates an image sensor, 23 designates an image processing device, 24 designates magnification/reduction means, 25 designates a memory, 26 designates a laser device, 27 designates an image forming apparatus, 28 designates a user interface panel, and 29 designates ten keys.

The transfer material tray 17 consists of transfer sheet trays 17*a*, 17*b*, and 17*c* for different sizes, and a manual sheet feed tray 17*d*. The image forming apparatus is a color copier, and therefore the developing device 2 is configured by a black (K) developing device 2K, a yellow (Y) developing device 2Y, a magenta (M) developing device 2M, and a cyan (C) developing device 2C.

The discharge corotron 11 consists of an internal discharge corotron 11*a* and an external discharge corotron 11*b*.

The image forming apparatus comprises: the input device 19 which scans an original image placed on the edition information input device 18 of an image information input device 5 and inputs image information; the memory 25 which stores the input image information, conducts an edition as required, and stores the edition information, and which consists of plural blocks; the image processing device 23 which converts the input image information on the basis of the edition information stored in the memory; the magnification/reduction means 24 which changes the size of the processed image to a specified one: and the image output device 27 which outputs the edited image.

In the image input device 19, the exposure lamp 21, the image sensor 22, etc. are arranged below a platen glass on which an original image is to be placed. The original image irradiated with the exposure lamp 21 is converted into image information by the image sensor 22.

The input image information is stored in a predetermined area of the memory 25. The edition information input device 18 comprises a digitizer, and is used for inputting an edition position and contents of the edition. The edition information input from the edition information input device 18 is stored in a predetermined area of the memory 25.

In the image forming apparatus 27, the charging device 15, the laser device 26, the developing device 2, the transfer corotron 10, the cleaning device 16, etc. are sequentially arranged around the photosensitive drum 1 which rotates in the direction of the arrow. A first color toner image which is developed by the developing device 2 is transferred to the transfer material 8 attracted and held onto the transfer drum 3.

Thereafter, the transfer cycle is repeatedly conducted for each of required colors. The transfer material 8 onto which all toner images have been transferred is separated from the transfer drum 3 by the separation corotron 12, and then transported to the fixing device 9 in which the toner is subjected to the heating/pressurizing fixing operation so as to be fixed to the transfer material. Thereafter, the transfer material is ejected to the outside of the image forming apparatus. A special transfer material such as a thick sheet, or an envelope is fed through the manual sheet feed tray 17*d*.

As described above, the registration roll 4 is disposed upstream of the position where the photosensitive drum 1 opposes the transfer drum 3, i.e., the transfer portion, and the curling device 5 is disposed between the registration roll 4 and the transfer portion.

The nip operation of the curling device 5 is executed in accordance with the thick sheet mode, the double-side copy mode, the manual sheet feed mode, and combinations of these modes which are set through the user interface panel 28.

According to the thus configured image forming apparatus, image formation positions are prevented from being shifted from each other particularly when a multicolor image is to be formed by using a thick transfer material, when a double-side copy is to be obtained by using a usual transfer material, and when a special transfer material such as an envelope is used. Therefore, a control system of an image forming apparatus which can form an image of high quality can be provided.

As described above, according to the invention, the color misalignment in the process direction which may be caused by difference in sheet resistance between transfer materials in the case where a normal sheet and a special transfer material such as an OHP sheet, a thick transfer material, or an envelope are used, or in peripheral speed between the registration roll and the curling device can be prevented from occurring. When the copy operation in the double-side copy is to De done on the second side, the transfer material can be held by the transfer drum at a correct position and attraction and holding can be surely attained, so that the transfer material can be stably moved to the transfer portion. Furthermore, the elastic roll constituting the curling device is prevented from being deformed. Consequently, an image of high quality can be formed.

What is claimed is:

1. An image forming apparatus comprising:

an image carrier;

a developing device which develops an electrostatic latent image formed on a surface of said image carrier by toner, thereby forming a toner image;

a transferring device which is disposed opposingly contacting with said image carrier, which electrostatically attracts and transports a transfer material fed between said image carrier and said transferring device, and which transfers the toner image carried on said image carrier to the transfer material;

a registration device which provides a timing of feeding the transfer material which is to be fed to a portion where said image carrier opposingly contacts with said transferring device;

a curling device which is disposed upstream of said portion where said image carrier opposingly contacts with said transferring device, in a direction of transporting the transfer material, and which produces a curl in the transfer material, said curl being curved in the same direction as said transferring device; and a control device which, during a period when said curling device is activated, inhibits an image forming operation, and which, after said curling device is activated, starts the image forming operation.

2. The image forming apparatus of claim 1, wherein said apparatus further comprises:

mode setting means for setting a mode in which the transfer material is a thick sheet, and said curling device is activated on the basis of the setting of said mode setting means.

3. The image forming apparatus of claim 1, wherein said apparatus further comprises:

mode setting means for instructing that the transfer material is an envelope, and said curling device is activated on the basis of the setting of said mode setting means.

4. The image forming apparatus of claim 1, wherein said apparatus further comprises mode setting means for instructing that a copy mode is set to double-side copy, and said curling device is activated on the basis of the setting of said mode setting means and before a transfer is conducted on a second side of the transfer material.

5. The image forming apparatus of claim 4, wherein said curling device is operated so that, with respect to the second side of the transfer material, a curling operation is applied only on a region which is separated from a front end of the transfer material by a distance which is shorter than a distance between said curling device and said opposingly contacting portion.

6. The image forming apparatus of claim 1, wherein existence of an image on a back side of the transfer material fed to said registration device is detected, and said curling device is activated in response to a signal indicative of existence of an image.

7. The image forming apparatus of claim 1, wherein said apparatus further comprises:

manual sheet feed mode setting means for instructing that the transfer material is fed from a manual sheet feed tray, and said curling device is activated on the basis of the setting of said manual sheet feed mode setting means.

8. The image forming apparatus of claim 7, wherein said apparatus further comprises:

mode setting means for instructing that the transfer material is at least a thick sheet, and, when a manual sheet feed mode is set in said manual sheet feed mode setting means and a thick sheet mode is not set in said mode setting means, said curling device is operated so that a curling operation is applied only on a region which is separated from a front end of the transfer material by a distance which is shorter than a distance between said curling device and said opposingly contacting portion.

9. The image forming apparatus of claim 1, wherein transparentness/opaqueness of the transfer material fed to said registration device is detected, and, when transparentness of the transfer material is detected, said curling device is inhibited from operating.

10. The image forming apparatus of claim 9, wherein, when a manual sheet feed mode is set in manual sheet feed mode setting means, and in a case that transparentness of the transfer material fed from a manual sheet feed tray is detected, said curling device is inhibited from operating, in a case that opaqueness of the transfer material fed from said manual sheet feed tray is detected, said curling device is operated so that a curling operation is applied only on a region which is separated from a front end of the transfer material by a distance which is shorter than a distance between said curling device and said opposingly contacting portion.

11. The image forming apparatus of claim 1, wherein said curling device comprises:

an elastic roll of a larger diameter;

a hard roll of a smaller diameter; and, a nip operation mechanism for said rolls, and, when a power for said image forming apparatus is shut down, a nip operation of said larger elastic roll and said smaller hard roll is canceled.

12. An image forming apparatus, comprising:

developing means for developing a toner image from a latent image formed on a surface of an imaging means;

transferring means for electrostatically attracting and transporting a transfer material fed between the imaging means and the transferring means, the transferring means further transferring the toner image carried on the imaging means to the transfer material;

registration means for feeding the transfer material to the imaging means;

curling means for producing a curl in the transfer material, the curl being curved in a same direction as the transferring means; and controlling means for inhibiting an image forming operating when the curling means is activated and starting an image forming operation after the curling means is activated.

13. The apparatus of claim 12, wherein the registration means nips a front end of the transfer material so that the transfer material is stopped.

14. The apparatus of claim 12, further comprising mode setting means for setting a thick sheet mode when the transfer material is a thick sheet, and the curling means is activated on the basis of the thick sheet mode setting.

15. The apparatus of claim 12, further comprising mode setting means for setting an envelope mode when the transfer material is an envelope, and the curling means is activated on the basis of the envelope mode setting.

16. The apparatus of claim 12, further comprising mode setting means for setting a double side copy mode when a transfer material includes a double sided copy, and the curling means is activated on the basis of the double side copy mode setting before a transfer is conducted on a second side of the transfer material.

17. A method for curling a sheet of paper in an image forming apparatus, comprising:

developing a toner image from an electrostatic latent image formed on a surface of an image carrier;

transferring the toner image carried on the image carrier to a transfer material;

curling the transfer material so that a curve is formed in a same direction as the transferring device; and controlling an image forming operation, wherein the image forming operation stops during a period when the curling takes place, and the image forming operation starts after the curling of the transfer material.

* * * * *